US012565773B2

(12) United States Patent
Worden et al.

(10) Patent No.: US 12,565,773 B2
(45) Date of Patent: Mar. 3, 2026

(54) LIGHTWEIGHT THERMAL BARRIER PANEL AND ANCHOR SYSTEM FOR BUILDING ENVELOPES AND METHOD FOR INSTALLING THE SAME

(71) Applicant: StudioTJOA, Inc., Erie, CO (US)

(72) Inventors: Alexander G. Worden, Erie, CO (US); Audrey L. Worden, Erie, CO (US)

(73) Assignee: StudioTJOA, Inc., Erie, CO (US)

( * ) Notice: Subject to any disclaimer, the term of this patent is extended or adjusted under 35 U.S.C. 154(b) by 512 days.

(21) Appl. No.: 18/095,104

(22) Filed: Jan. 10, 2023

(65) Prior Publication Data

US 2023/0220667 A1 Jul. 13, 2023

Related U.S. Application Data

(60) Provisional application No. 63/298,883, filed on Jan. 12, 2022.

(51) Int. Cl.

| | |
|---|---|
| ***E04B 2/96*** | (2006.01) |
| ***F24F 7/04*** | (2006.01) |
| *F24F 7/00* | (2021.01) |

(52) U.S. Cl.

CPC ..... *E04B 2/967* (2013.01); *F24F 7/04* (2013.01); *F24F 2007/0025* (2021.01)

(58) Field of Classification Search

CPC ... E04B 2/967; E04B 2/90; E04B 2/96; E06B 3/28; E06B 3/285; E06B 3/2605

See application file for complete search history.

(56) References Cited

U.S. PATENT DOCUMENTS

| | | | | | |
|---|---|---|---|---|---|
| 1,845,653 | A | | 2/1932 | Fasset | |
| 2,276,112 | A | * | 3/1942 | Stoneback | E06B 3/64 52/172 |
| 2,587,567 | A | | 2/1952 | Easton | |
| 3,176,806 | A | | 4/1965 | Ferrell | |
| 3,991,806 | A | * | 11/1976 | Abell | E06B 3/285 160/90 |
| 4,057,936 | A | * | 11/1977 | Wyatt, Jr. | E06B 3/00 52/843 |
| 4,089,143 | A | * | 5/1978 | La Pietra | E06B 3/28 52/208 |
| 4,098,035 | A | | 7/1978 | Bessler | |
| 4,255,907 | A | | 3/1981 | Lightell | |

(Continued)

FOREIGN PATENT DOCUMENTS

| | | |
|---|---|---|
| AU | 2019301580 | 1/2021 |
| CN | 101268238 | 9/2008 |

(Continued)

*Primary Examiner* — Adriana Figueroa

(74) *Attorney, Agent, or Firm* — Dorsey & Whitney LLP

(57) ABSTRACT

A lightweight thermal barrier panel and anchor assembly for installation on a new or existing building envelope is disclosed. The system includes a modular panel with an infill barrier and structural anchors. The anchors are attached to the new or existing building envelope on at least one side of the building envelope to receive the thermal barrier panel to create an air cavity between the panel and the building envelope. The thermal barrier panel framing includes openings within rigid framing members to promote ventilation of the air cavity to the at least one side of the thermal barrier panel.

19 Claims, 17 Drawing Sheets

(56) References Cited

U.S. PATENT DOCUMENTS

| | | | | |
|---|---|---|---|---|
| 4,320,609 | A * | 3/1982 | Abell | E06B 3/285 52/204.597 |
| 4,335,166 | A | 6/1982 | Lizardo et al. | |
| 4,450,660 | A * | 5/1984 | Dean | E06B 3/6608 29/455.1 |
| 4,452,020 | A * | 6/1984 | Werner | E06B 3/28 52/202 |
| 4,462,194 | A * | 7/1984 | Wahner | B32B 15/20 411/510 |
| 4,531,562 | A | 7/1985 | Swanson | |
| 4,614,069 | A * | 9/1986 | Tanikawa | E04B 2/96 52/475.1 |
| 4,627,206 | A * | 12/1986 | Cox | E06B 3/677 454/243 |
| 4,813,203 | A | 3/1989 | Newman et al. | |
| 5,108,811 | A | 4/1992 | Shippen | |
| 5,140,768 | A | 8/1992 | Forbes | |
| 5,467,546 | A | 11/1995 | Kovalak | |
| 5,490,358 | A | 2/1996 | Grunewald et al. | |
| 5,737,885 | A * | 4/1998 | Stoyke | E06B 3/28 52/202 |
| 6,343,447 | B2 | 2/2002 | Geissels et al. | |
| 6,509,071 | B1 * | 1/2003 | Emek | E06B 1/62 52/204.593 |
| 6,637,080 | B2 | 10/2003 | Verret | |
| 7,036,280 | B2 | 5/2006 | Hogan | |
| 7,040,062 | B2 * | 5/2006 | Emek | E06B 5/12 52/214 |
| 7,281,561 | B2 | 10/2007 | Anderson et al. | |
| 7,464,506 | B2 | 12/2008 | Atkinson | |
| 7,600,350 | B2 | 10/2009 | Braunstein | |
| 7,607,267 | B2 * | 10/2009 | Fulton | E06B 3/677 52/302.1 |
| 7,827,746 | B2 | 11/2010 | Speck | |
| 7,922,224 | B2 | 4/2011 | Arias | |
| 8,397,449 | B2 * | 3/2013 | Yun | F24F 13/18 52/204.593 |
| 8,413,403 | B2 | 4/2013 | Walker et al. | |
| 8,484,916 | B2 | 7/2013 | Farag | |
| 8,530,011 | B2 | 9/2013 | Kleinhempel et al. | |
| 8,567,142 | B2 * | 10/2013 | Swartz | E06B 3/5427 52/745.12 |
| 8,578,671 | B2 | 11/2013 | Labrecque et al. | |
| 8,656,683 | B2 * | 2/2014 | Hedditch | A62C 3/14 52/784.11 |
| 8,760,750 | B2 | 6/2014 | Powers et al. | |
| 8,851,144 | B2 | 10/2014 | Forbis et al. | |
| 8,991,121 | B1 | 3/2015 | Baker | |
| 9,200,458 | B2 | 12/2015 | Harding | |
| 9,256,085 | B2 | 2/2016 | McCarthy et al. | |
| 9,453,344 | B2 | 9/2016 | Hall et al. | |
| 9,560,813 | B2 | 2/2017 | Hassle | |
| 9,593,524 | B2 | 3/2017 | Rasmussen et al. | |
| 9,617,733 | B2 | 4/2017 | Grise et al. | |
| 9,663,946 | B2 | 5/2017 | Frederick | |
| 9,957,714 | B2 | 5/2018 | Carolan et al. | |
| 9,976,335 | B2 | 5/2018 | Pardue et al. | |
| 10,053,859 | B2 | 8/2018 | Evensen et al. | |
| 10,087,639 | B1 | 10/2018 | Simonsen | |
| 10,156,089 | B2 * | 12/2018 | Bacon | E06B 3/28 |
| 10,202,763 | B2 | 2/2019 | Hogan et al. | |
| 10,267,087 | B2 | 4/2019 | Takada | |
| 10,280,679 | B2 * | 5/2019 | Al Kassas | E06B 3/56 |
| 10,407,902 | B2 * | 9/2019 | Doyon | E06B 3/54 |
| 10,443,234 | B2 | 10/2019 | Stronks et al. | |
| RE47,733 | E | 11/2019 | West | |
| 11,203,876 | B2 | 12/2021 | Delaney et al. | |
| 11,345,130 | B2 | 5/2022 | Augustyniak | |
| 11,415,328 | B2 | 8/2022 | Goldstein | |
| 2008/0245002 | A1 | 10/2008 | Van de Linde et al. | |
| 2010/0065225 | A1 | 3/2010 | Braunstein et al. | |
| 2013/0129944 | A1 | 5/2013 | Theios et al. | |
| 2014/0113541 | A1 * | 4/2014 | Drier | E06B 7/02 454/314 |
| 2023/0084137 | A1 | 3/2023 | Slagter et al. | |

FOREIGN PATENT DOCUMENTS

| | | |
|---|---|---|
| DE | 102011081255 | 11/2013 |
| DE | 202018104297 | 10/2019 |
| EP | 2142718 | 4/2018 |
| GB | 2468915 | 3/2013 |
| JP | 3180823 | 1/2013 |
| JP | 5259490 | 8/2013 |
| JP | 5870450 | 3/2016 |
| JP | 6716277 | 7/2020 |
| KR | 101377372 | 3/2014 |

* cited by examiner

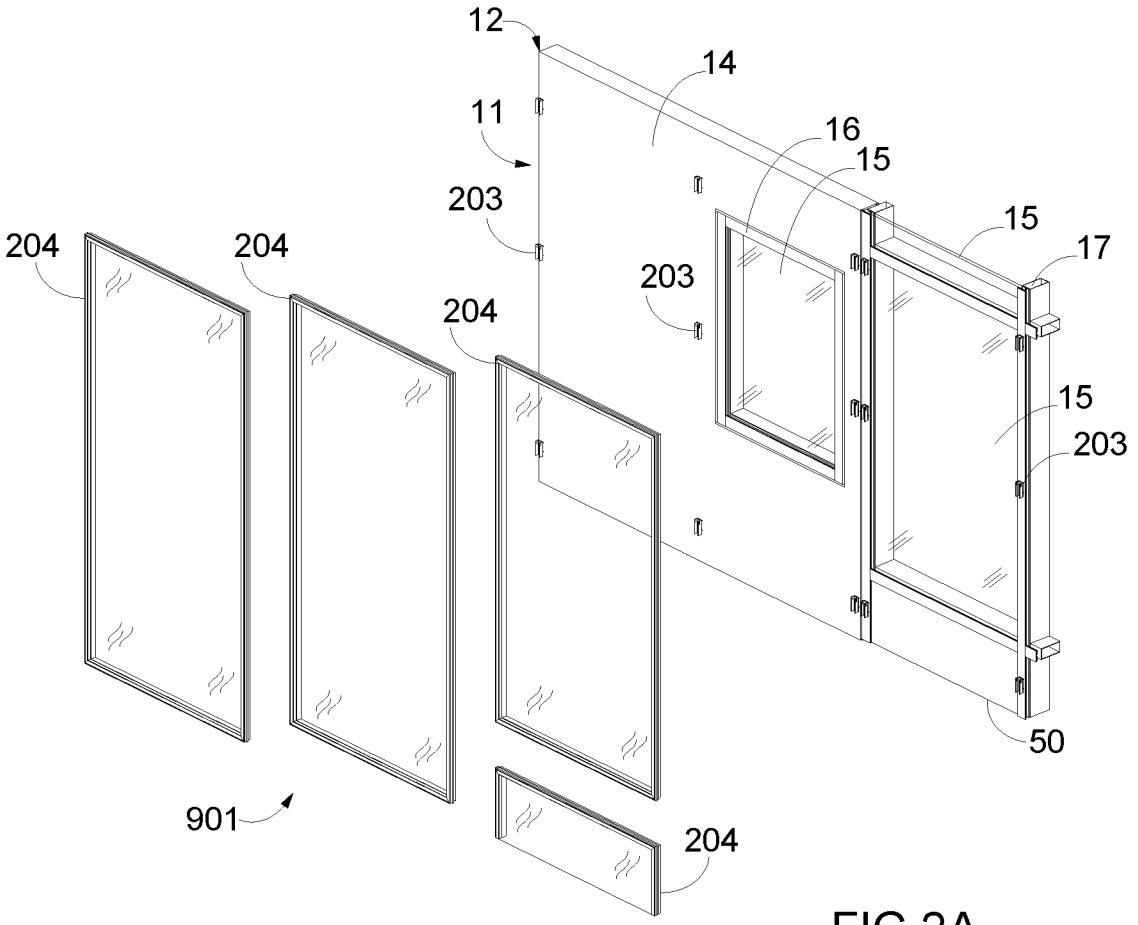
FIG.2A
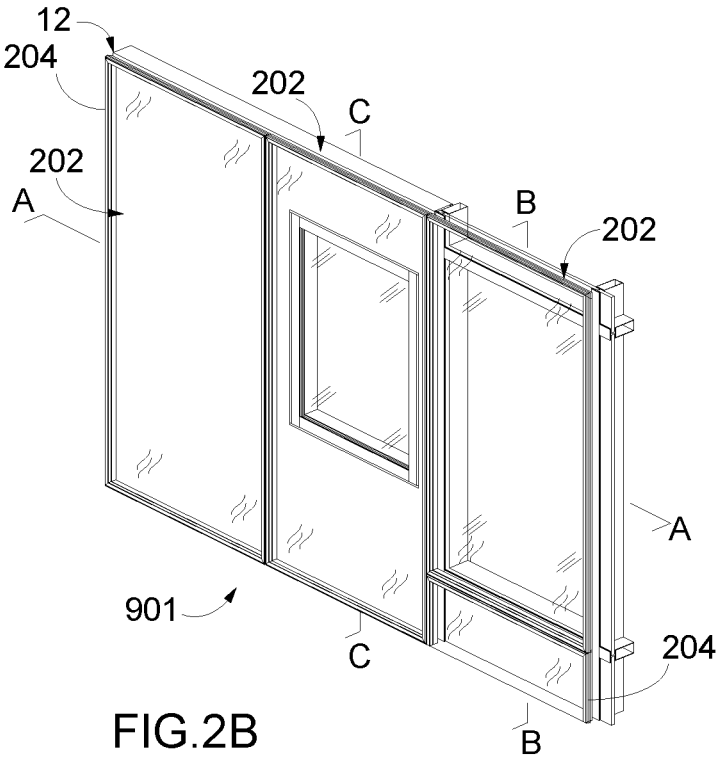
FIG.2B
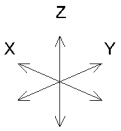

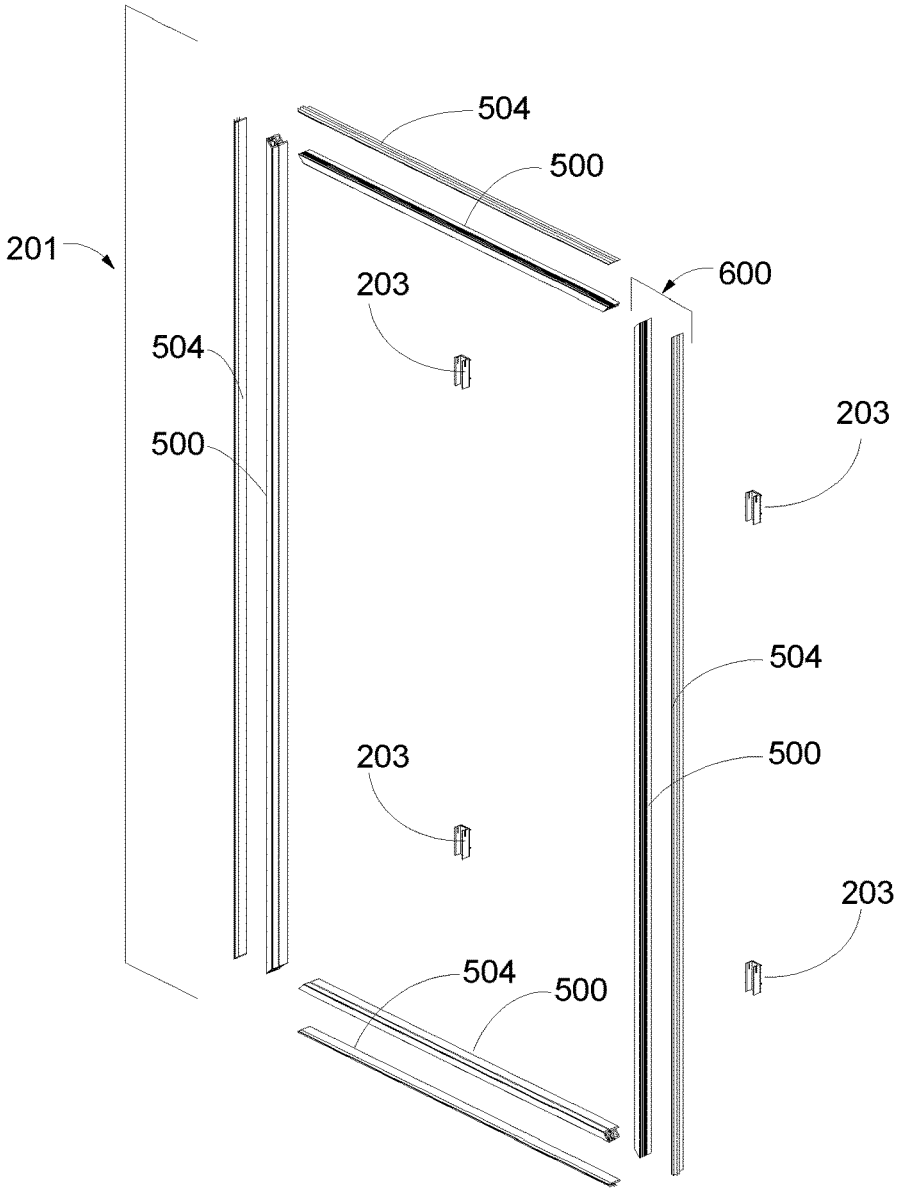
FIG.4A
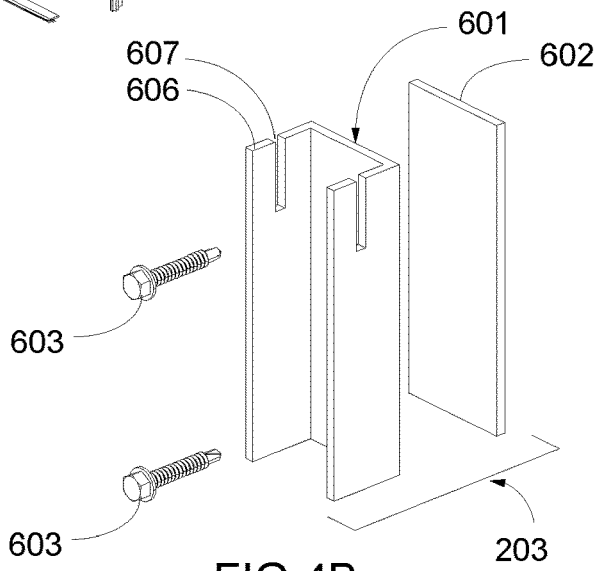
FIG.4B
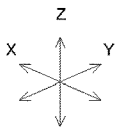

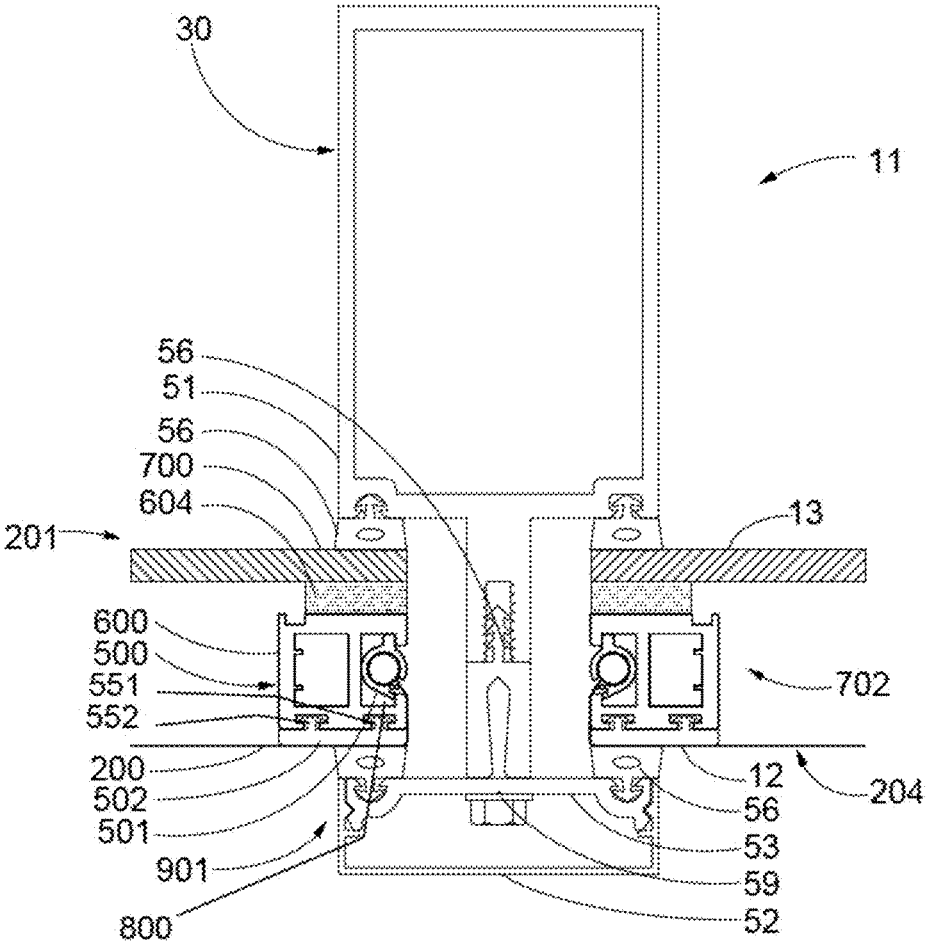
FIG.15
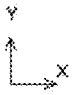

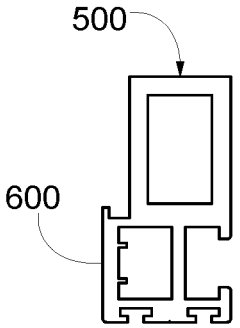
FIG.16A
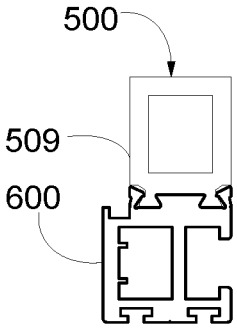
FIG.16B
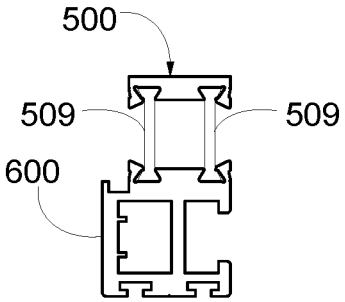
FIG.16C
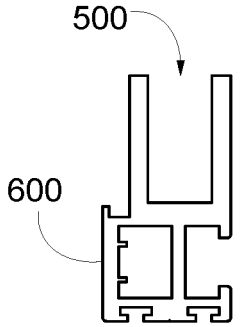
FIG.16D
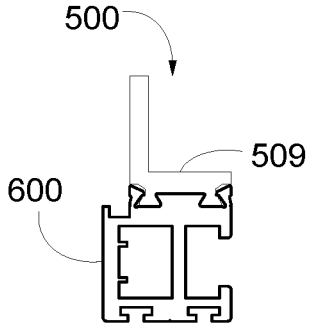
FIG.16E
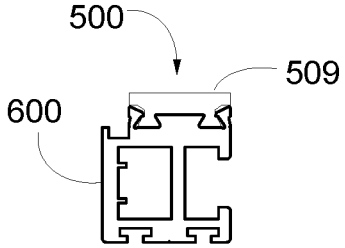
FIG.16F
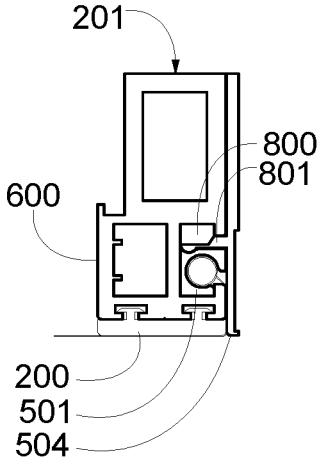
FIG.17A
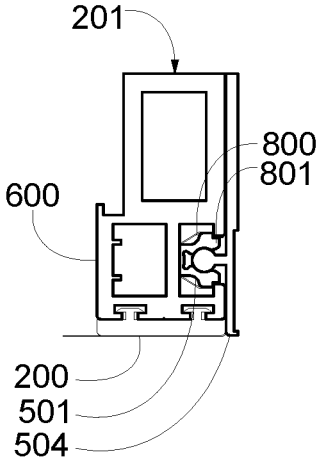
FIG.17B
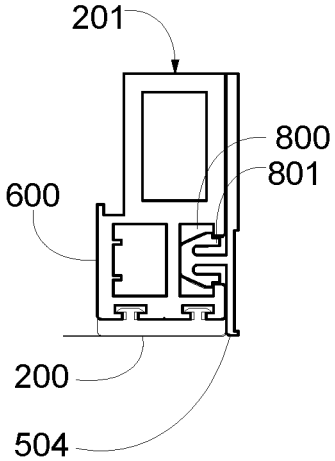
FIG.17C
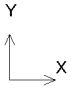

LIGHTWEIGHT THERMAL BARRIER PANEL AND ANCHOR SYSTEM FOR BUILDING ENVELOPES AND METHOD FOR INSTALLING THE SAME

CROSS REFERENCE OR RELATED APPLICATIONS

This application claims priority of U.S. Provisional Patent Application Ser. No. 63/298,883, filed on Jan. 12, 2022, which is incorporated herein by reference for any purpose.

BRIEF SUMMARY OF THE INVENTION

The present invention relates to a building envelope and window glazing attachments, specifically creating a thermal barrier or barriers opposite a new or existing building envelope consisting of opaque, transparent or translucent assemblies or combination therein to capture and contain air for use as a thermal insulator to increase the thermal resistance across the building envelope coupled with ventilation strategies to enable the ventilation of the cavity air when required.

BRIEF DESCRIPTION OF THE SEVERAL VIEWS OF THE DRAWING

The present disclosure may be more completely understood in consideration of the following descriptions of various embodiments of the present disclosure in connection with the accompanying drawings. In the drawings, like elements are depicted by the like reference numerals. The drawings are briefly described as follows.

FIG. 2A is an enlarged axonometric view of a portion of a new or existing building envelope comprising, for example, an opaque wall, transparent punched window and curtainwall glazing system with a plurality of thermal barrier panels being installed and affixed to the thermal barrier panel anchor assemblies affixed to the various wall types of the existing building envelope in accordance with one embodiment of the present disclosure.

FIG. 2B is an enlarged axonometric view of a plurality of thermal barrier panels and anchor assemblies installed over the various wall types of a new or existing building envelope in accordance with one embodiment of the present disclosure.

FIG. 4A is an exploded axonometric view of the thermal barrier panel frame assembly comprising mullions or transoms along with anchor assemblies in accordance with one embodiment of the present disclosure.

FIG. 4B is an exploded axonometric view of the thermal barrier panel anchor assembly prior to being installed on the building envelope in accordance with one embodiment of the present disclosure.

FIG. 15 is a sectional view of a plurality of thermal barrier panels assembly along line A-A or B-B or C-C of FIG. 2B, affixed within the glazed building curtainwall mullion or transom assembly wherein the thermal barrier panels comprising a mullion or transom assembly configured to receive at least one transparent, translucent or opaque rigid sheet-like infill barrier and at least one infill barrier create an enclosed cavity wherein the thermal barrier panel create a primary enclosure barrier within the glazing frame assembly of a building envelope in accordance with further embodiments of the present disclosure.

FIG. 16A is a sectional view of a rigid framing member of the thermal barrier panel mullion or transom assembly in accordance with one embodiment of the present disclosure.

FIG. 16B is a sectional view of a rigid framing member of the thermal barrier panel mullion or transom assembly in accordance with further embodiments.

FIG. 16C is a sectional view of a rigid framing member of the thermal barrier panel mullion or transom assembly in accordance with further embodiments.

FIG. 16D is a sectional view of a rigid framing member of the thermal barrier panel mullion or transom assembly in accordance with further embodiments.

FIG. 16E is a sectional view of a rigid framing member of the thermal barrier panel mullion or transom assembly in accordance with further embodiments.

FIG. 16F is a sectional view of a rigid framing member of the thermal barrier panel mullion or transom assembly in accordance with further embodiments.

FIG. 17A is a sectional view of the thermal barrier panel mullion or transom assembly pressure fitting and perimeter trim member in accordance with one embodiment of the present disclosure.

FIG. 17B is a sectional view of the thermal barrier panel mullion or transom assembly pressure fitting and perimeter trim member in accordance with further embodiments.

FIG. 17C is a sectional view of the thermal barrier panel mullion or transom assembly pressure fitting and perimeter trim member in accordance with further embodiments.

The present disclosure now will be described more fully hereinafter with reference to the accompanying drawings, which show various example embodiments. However, the present disclosure may be embodied in many different forms and should not be construed as limited to the example embodiments set forth herein. Rather, the intention is to cover all modifications, equivalents and alternatives falling within the spirit and scope of the present disclosure as defined by the appended claims

DETAILED DESCRIPTION OF THE INVENTION

Figure 1A:
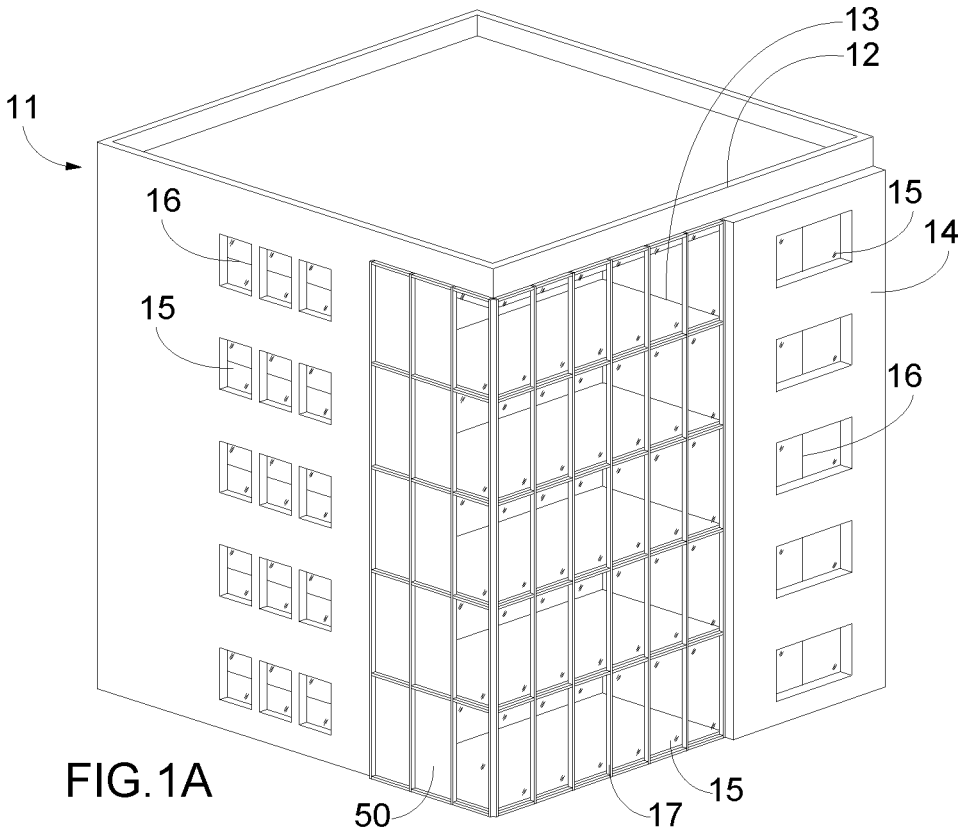
FIG. 1A is an axonometric view of a new or existing building envelope comprising for example, opaque walls, punched windows and curtainwall system.

FIG. 1A is an axonometric view of a new or existing building envelope 11 for reference, comprising, for example an opaque wall 14, punched windows 16 with glazing 15 and curtainwall system 17 with glazing 15 and rigid sheet-like infill 50 wherein the building envelope 11 comprising at least a first exterior side 12 and a second interior side 13 according to some embodiments.

Figure 1B:
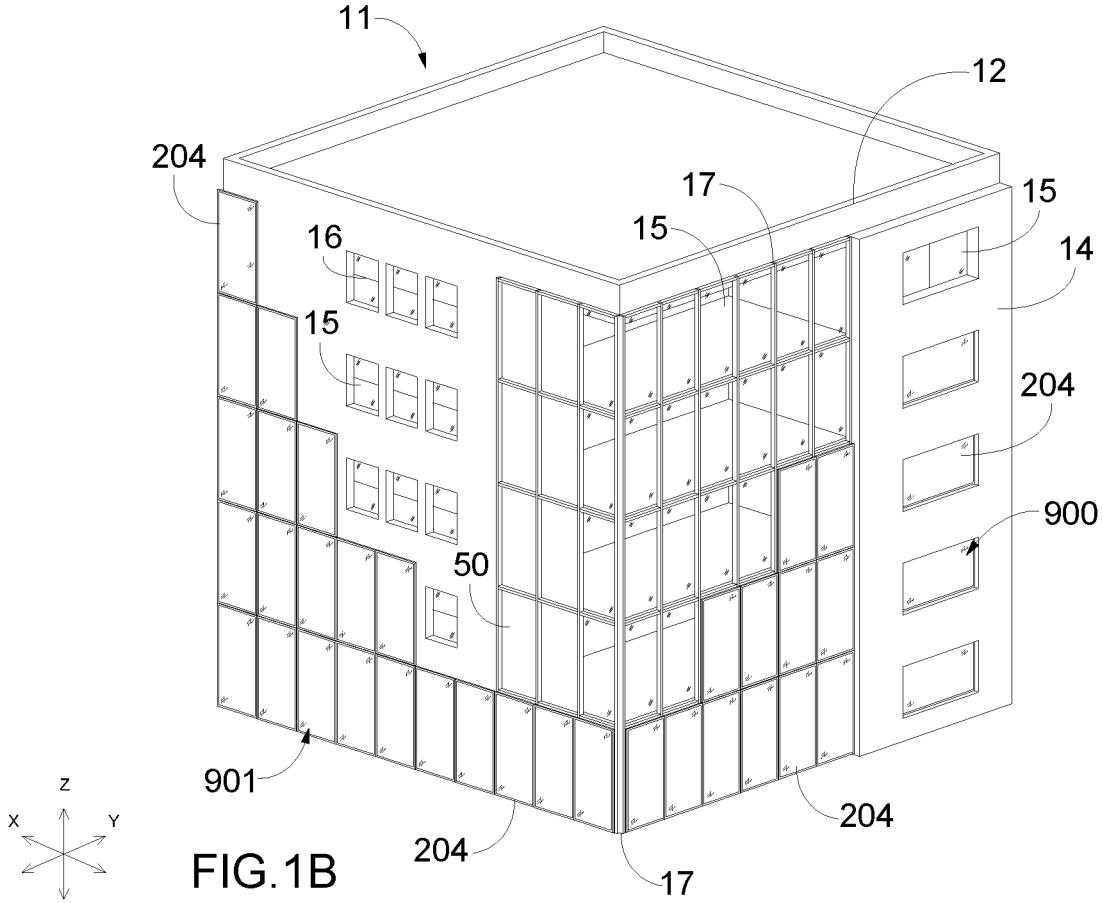
FIG. 1B is an axonometric view of a plurality of thermal barrier panels and anchor assemblies partially installed over the new or existing building envelope in accordance with one embodiment of the present disclosure.

FIG. 1B illustrates an axonometric view of a new or existing building envelope 11 comprising a combination of opaque wall 14, punched windows 16 with glazing 15 and curtainwall system 17 with glazing 15 and transparent, translucent or opaque rigid sheet-like infill 50 wherein the thermal barrier panel 204 is affixed to the exterior side 12 of the building envelope 11 in a panel plurality 901 wherein the thermal barrier panel 204 cover the opaque wall 14 and curtainwall system 17 with glazing 15 and said rigid sheet-like infill 50. Addition, the thermal barrier panel is affixed to the exterior first side 12 of the building envelope 11 in a singular panel 900 application wherein a thermal barrier panel 204 cover the punched windows 16 with glazing 15 in accordance with one embodiment of the present disclosure.

Referring now to FIG. 2A which depicts an enlarged portion of a new or existing building envelope 11 comprising a combination of opaque wall 14, punched windows 16 with glazing 15 and curtainwall system 17 with glazing 15 and transparent, translucent or opaque rigid sheet-like infill 50 wherein the thermal barrier panel anchor assembly 203 is first affixed to the first exterior side 12 of, for example, the opaque wall 14, punched windows 16 with glazing 15 and curtainwall system 17 of the new or existing building envelope 11. FIG. 2A further depicts a plurality of thermal barrier panels 204, 901 prior to installation onto the respect anchor assembles 203 to cover the various envelope systems comprising the new or existing building envelope 11

FIG. 2B illustrates the various enclosure assemblies of the new or existing building envelope 11 wherein, for example, a plurality of thermal barrier panels 901, 204, are mounted to the thermal barrier panel anchor assembly 203 that are affixed to said new or existing building envelope 11 as depicted in FIG. 2A to create an air cavity 202 between the exterior first side 12 of said building envelope 11 and the thermal barrier panel 204. The depth of said air cavity 202 may vary between adjacent thermal barrier panels 204 or the depth of said air cavity 202 may vary across an individual thermal barrier panels 204 or a combination of the two, wherein for example, said thermal barrier panel is not parallel to the exterior first side 12 of said building envelope 11. Cross-sectional Lines depicted in FIG. 2B noted by A-A or B-B or C-C are to denote and identify the various orientations and locations of some of the following figures.

Figure 3A:
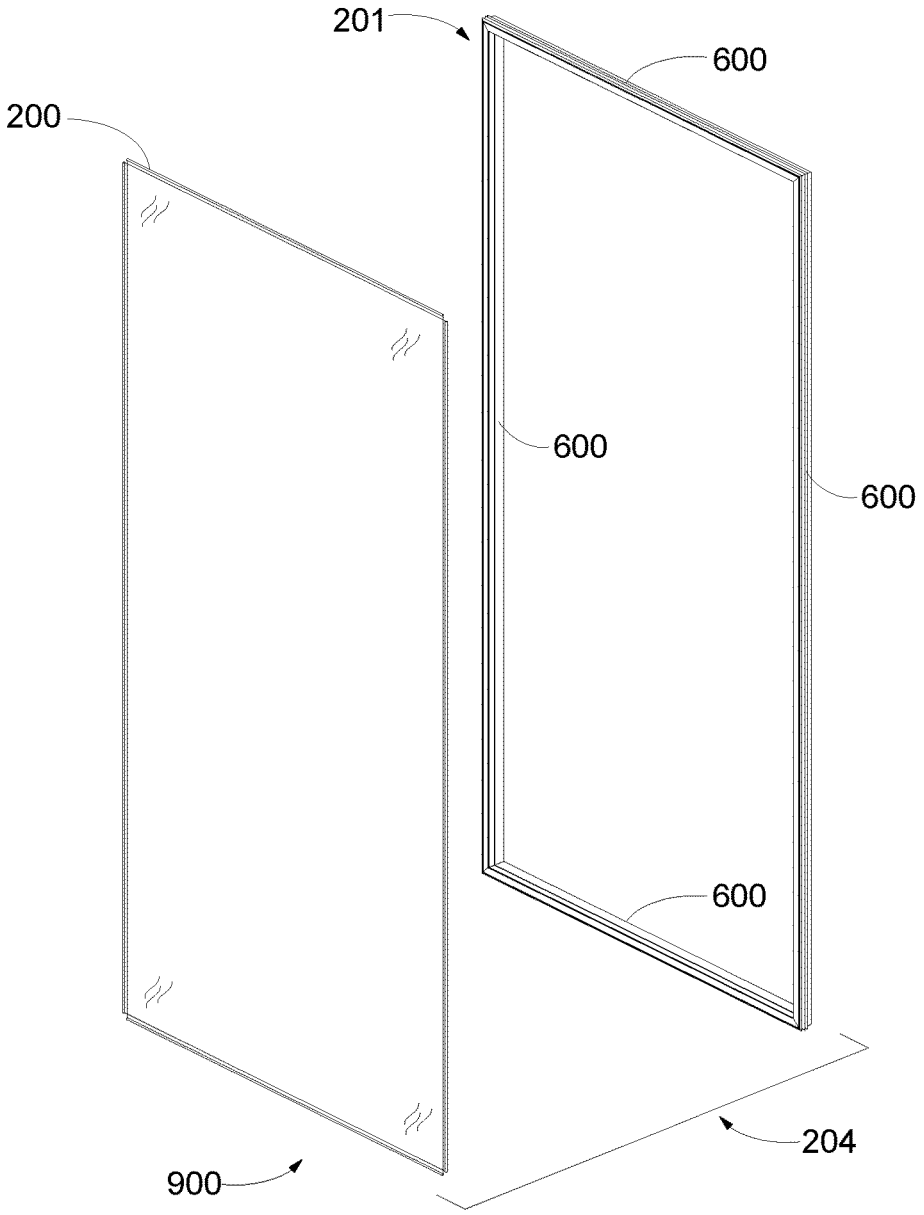
FIG. 3A is an axonometric view of a partially exploded thermal barrier panel depicting the panel frame assembly and the infill barrier prior to being affixed onto the panel frame in accordance with one embodiment of the present disclosure.

Referring now to FIG. 3A, which depict further component parts of an exploded and uninstalled, singular thermal barrier panel 900, 204. This illustrates the thermal barrier panel 204 comprising a panel frame assembly 201 and an infill barrier 200 with said panel frame assembly 201 comprising for example, four rigid framing members 600 that are assembled and connected into said panel frame assembly 201, by using, for example, mechanical fasteners, corner keys, adhesives, crimping techniques or other means of connection, etc. Said rigid framing members 600 may be assembled by a manufacturer and shipped to an assembly facility to form the panel frame assembly 201 or said rigid framing members 600 may be shipped to an assembly facility as individual members. In one embodiment of the present disclosure, the infill barrier 200 may be a noncombustible stretched transparent membrane comprising ethylene tetrafluoroethylene film, also known as ETFE, with a thickness between 12 and 500 nanometers. The ETFE film infill barrier 200 is affixed to said rigid framing members 600 of the respective panel frame assembly 201.

Figure 3B:
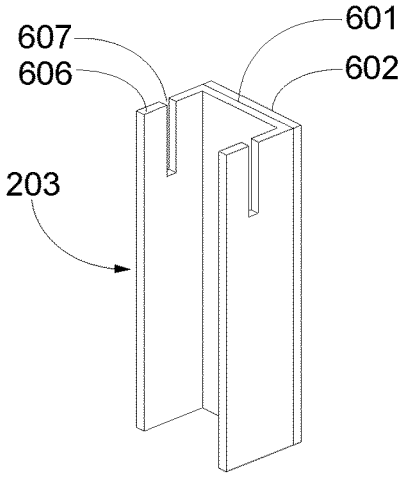
FIG. 3B is an axonometric view of the thermal barrier panel anchor assembly prior to being installed on the building envelope in accordance with one embodiment of the present disclosure.

FIG. 3B illustrates the thermal barrier panel anchor assembly 203 not yet affixed to the building envelope 11 or to the thermal barrier panel 204 as depicted in FIG. 2A in accordance with one embodiment of the present disclosure, wherein the anchor assembly 203 comprising a first anchor member 601 made from a rigid material such as metal, plastic or composite and said anchor member 601 has for example, at least one anchor leg 606 comprising a receiver slot 607 for anchoring and affixing at least one framing assembly member 600 of the panel frame assembly 201 depicted in FIG. 3A and a second anchor member 602 made from thermally insulative material to separate the first anchor member 601 from the building envelope 11 described in FIGS. 1A and 2A.

Referring now to FIG. 4A, which depicts further exploded component parts of the rigid framing members 600 of the panel frame assembly 201 as depicted in FIG. 3A in accordance with one embodiment of the present disclosure wherein said rigid framing members 600, comprising a mullion or transom assembly 500 as the primary structural framing element of said rigid framing members 600 and a perimeter trim member 504 used to cover the perimeter edge of said mullion or transom assembly 500 and cover an edge portion of said infill barrier 200 as depicted in FIG. 3A. Additionally, FIG. 4A shows for example, a plurality of thermal barrier panel anchor assemblies 203 and their relation to the mullion or transom assembly 500 of said rigid framing members 600 in accordance with one embodiment of the present disclosure FIG. 4B illustrates an exploded thermal barrier panel anchor assembly 203 not yet affixed to the building envelope 11 or to the thermal barrier panel 204 described in FIG. 2A, in accordance with one embodiment of the present disclosure, wherein the anchor assembly 203 comprising a first anchor member 601 made from a rigid material such as metal, plastic or composite and said anchor member 601 has at least one anchor leg 606 comprising a receiver slot 607 for anchoring and affixing at least one framing assembly member 600 of the panel frame assembly 201 depicted in FIG. 4A, a second anchor member 602 that is made of a thermally insulative material to separate the first anchor member 601 from the building envelope 11 described in FIGS. 1A and 2A, one or more anchor fasteners 603 pass through, penetrating both the first anchor member 601 and second anchor member 602 to affix the anchor assembly 203 to the exterior of the building envelope as described in FIG. 2A.

Figure 5A:
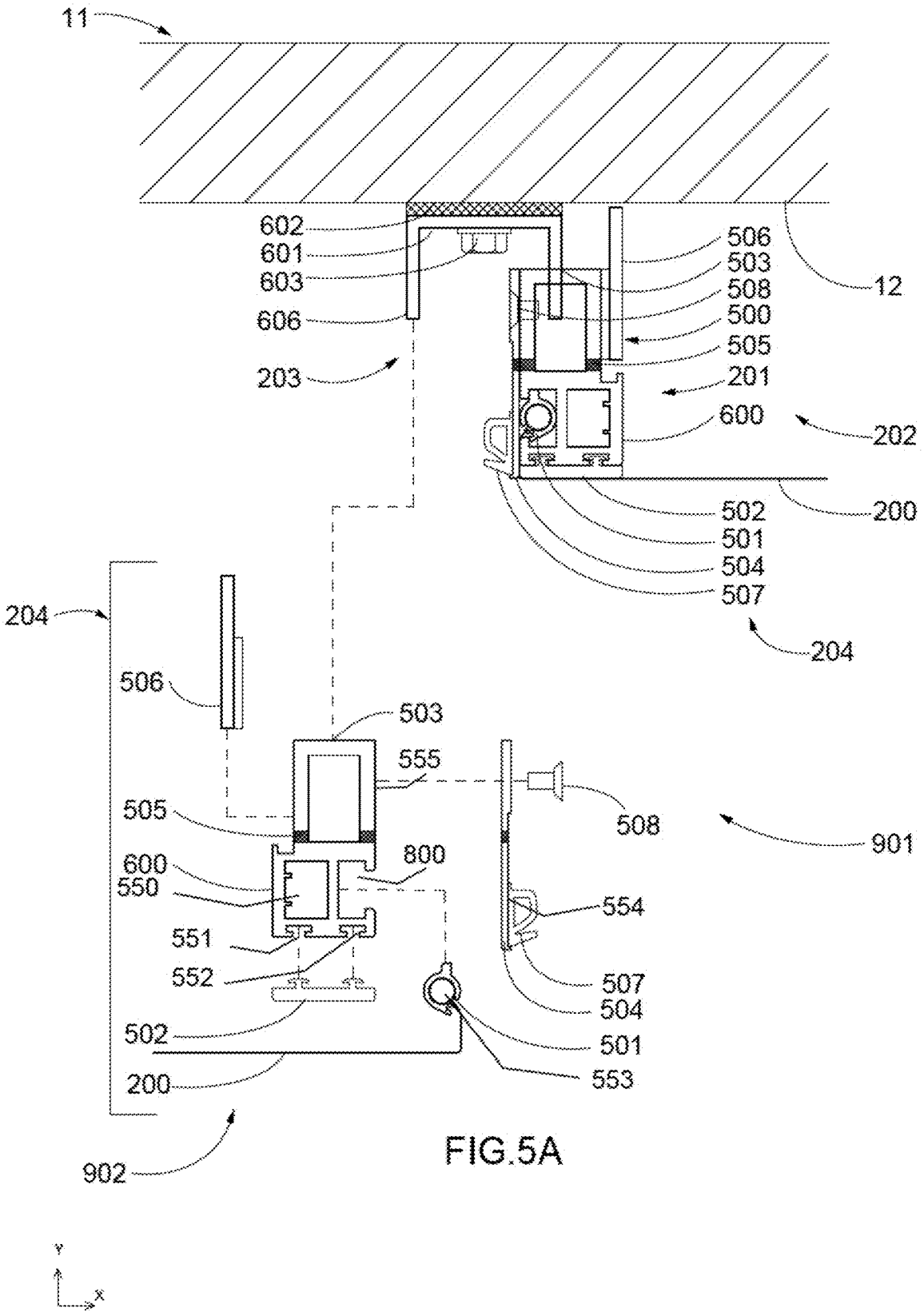
FIG. 5A is a cross sectional view of a plurality of thermal barrier panels and an anchor assembly that depicts both an exploded and assembled thermal barrier panel mounted to an anchor assembly affixed to one side of a building wall assembly; wherein the exploded thermal barrier panel depicts the component parts and relationship to each other and the assembly and the assembled thermal barrier panel depicts how it engages and covers the wall assembly of a building envelope in accordance with one embodiment of the present disclosure.

FIG. 5A depicts a cross sectional view of a plurality of thermal barrier panels 204 and an anchor assembly 203 in accordance with one embodiment of the present disclosure wherein one of said thermal barrier panels 204 is exploded 902 into component parts to illustrate the assembly of the thermal barrier panel 204 and the other thermal barrier panel 204 depicted illustrates how the thermal barrier panel 204 and anchor assembly 203 engage and affix onto for example, the exterior first side 12 of a new or existing building envelope 11

Starting with the thermal barrier panel anchor assembly 203 comprising for example, a first anchor member 601 and second anchor member 602 are affixed to the first exterior side 12 of a new or existing building envelope 11 through use of one or more anchor fasteners 603. The anchor assembly 203 is configured to promote the anchoring of one or more thermal barrier panels 204 to cover over the first exterior side 12 of a new or existing building envelope 11 to create an air cavity 202 as defined the first exterior side 12 or said building envelope 11 and the stretched membrane infill barrier 200 of the thermal barrier panels 204.

In one embodiment of the present disclosure, as depicted in the exploded thermal barrier panel 204, 902 one or more edges of the infill barrier 200 may be fitted with a pressure fitting 501 with a groove 553 to receive the infill barrier 200 prior to installation onto the panel frame assembly 201. Prior to the installation of said infill barrier 200 The panel frame assembly 201 may be built with said panel frame assembly 201 comprising two or more assembly mullions or transoms 500 including a cross section 550, wherein the primary rigid framing member 600 of said assembly mullions or transoms 500 may be cut, drilled, slotted, grooved, knurled, or any such process required prior to frame assembly, after which said primary rigid framing member 600 are affixed to one another by using, for example, mechanical fasteners, corner keys, adhesives, crimping techniques or other means of connection, etc. Once said rigid framing members 600 are joined in a frame the following components are cut, shaped, and affixed to said rigid framing members 600 in the configuration of the frame as defined by the number and shape of said rigid framing members 600 wherein the closure baffle members 506 may be attached to the rigid framing members 600 through mechanical or adhesive fixity, at least one buffer gasket 502 engages the cross section 551, 552 of the rigid framing members 600 to protect and separate the infill barrier 200 from the rigid framing member 600 completing the overall panel framing assembly 201 after which, the infill barrier 200 may be affixed to the rigid framing members 600 of said panel framing assembly 201 by engaging pressure fitting 501 into the cross section receiver slot 800 of one or more rigid framing member 600 resulting in a stretched membrane infill barrier 200 spanning across the panel frame assembly 201. Once the infill barrier 200 is installed, the perimeter trim member 504 comprising a rigid material that may be, for example, metal, plastic, composite or other, etc. with a perimeter sealing gasket 507 affixed to a receiving groove 554 of the perimeter trim member 504, is attached to a receiving surface 555 of the rigid framing members 600 using for example, a fastener 508 wherein the perimeter trim member 504 covers the engaged pressure fitting 501 of the infill barrier 200 edge. The completed assembly of the thermal barrier panel 204 may be affixed to the building envelope 11 through the engagement of at least one first anchor leg 606 of thermal barrier panel anchor assembly 203 on or into an anchor surface or groove 503 of at least one of said rigid framing members 600 that makes up the panel framing assembly 201 of the thermal barrier panels 204. Once said thermal barrier panel 204 is installed on the anchor assembly 203 in a panel plurality 901 the perimeter sealing gasket 507 of each adjacent thermal barrier panel 204 may, for example create an air and weather seal that may for example, minimize air and water infiltration and create the air cavity 202 between the infill barrier panel 204 and the first exterior side of the building envelope 11 as defined by the outer most surface of the stretched membrane infill barrier 200 across to the first exterior side 12 of the new or existing building envelope.

Heat buildup within the air cavity 202 that may be created by the thermal barrier panels 204 and the building envelope 11 may for example, flow through the vent penetrations 505 of the panel frame assembly 201 and exit to the exterior. Additional vent penetrations 505 may be located to promote actively or passively controlled ventilation of said air cavity 202 as well as the shape and location of said perimeter sealing gasket may be adjusted to promote the transfer of cavity air to the exterior while minimizing air and water infiltration into said air cavity 202.

Figure 5B:
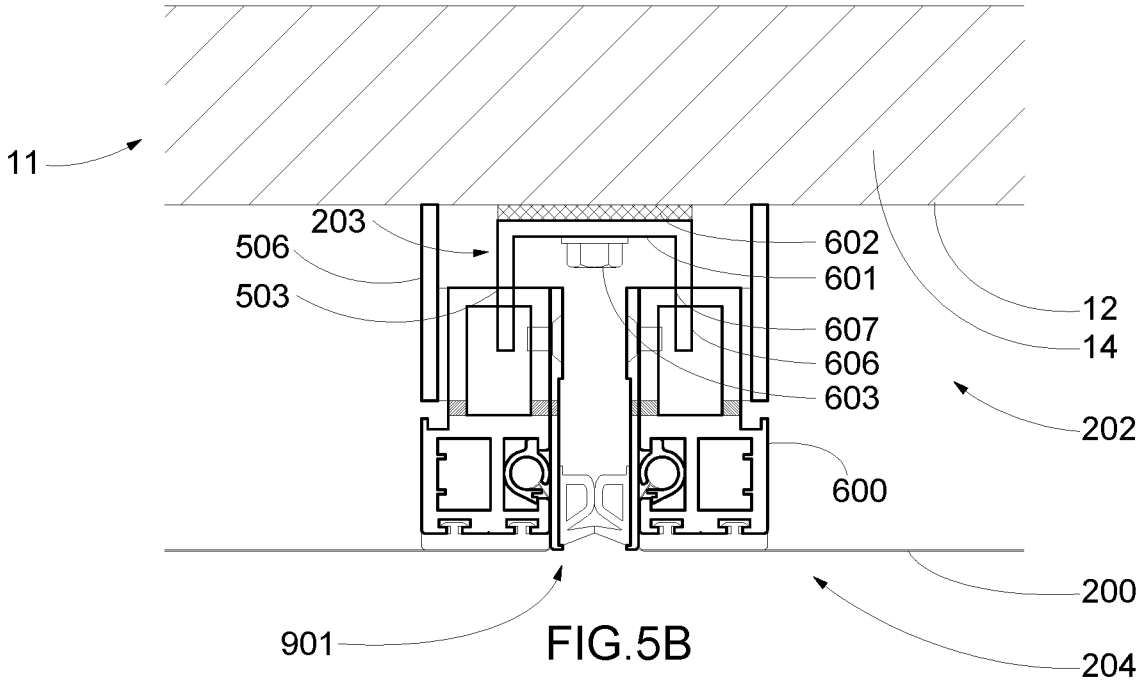
FIG. 5B is a fully assembled sectional view of FIG. 5A which depicts a plurality of thermal barrier panels and an anchor assembly along line A-A or C-C of FIG. 2B affixed to one side of an opaque building wall assembly wherein the thermal barrier panels cover the wall assembly of a building envelope in accordance with one embodiment of the present disclosure.

Referring now to FIG. 5B, in accordance with one embodiment of the present disclosure, depicts a cross sectional view along line A-A or C-C of FIG. 2B of a plurality 901 of two fully assembled thermal barrier panels 204 installed and affixed to an opaque wall assembly 14 of a new or existing building envelope 11 through the engagement of an anchor assembly 203 wherein each thermal barrier panels 204 depicted may be identical in composition and assembly to adjacent panels and to the exploded thermal barrier panels 902, 204 depicted and described in FIG. 5A. The opaque wall assembly 14 of the new or existing building envelope 11 may be comprised of any opaque material for example, brick, stone, masonry, concrete, metal, wood, composite material, other, etc, wherein the anchor fastener 603 or the thermal barrier panel anchor assembly 203 may penetrate the first and second anchor members 601, 602 and affix to the exterior first side 12 of said building envelope 11 so that the anchor legs 606 and receiver slots 607 may receive the anchor surface or groove 503 of the thermal barrier panel's 204 framing assembly member 600 and create an air cavity 202 as defined by the infill barrier 200, the closure baffle members 506 and the first exterior side 12 of the building envelope 11.

Figure 5C:
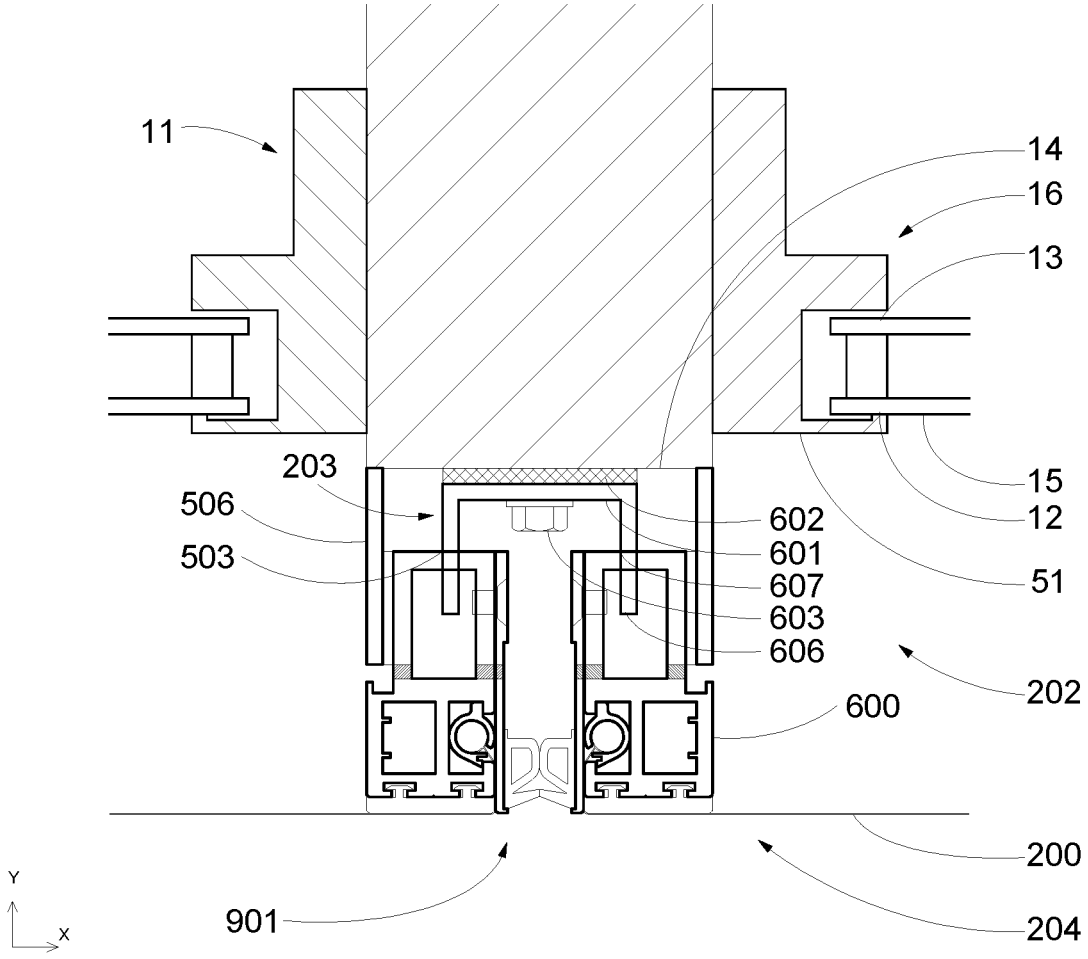
FIG. 5C is a sectional view of a plurality of thermal barrier panels and an anchor assembly along line A-A or B-B or C-C of FIG. 2B, affixed to one side of an opaque portion of the building wall assembly wherein the thermal barrier panels cover a transparent or translucent glazing assembly of a building envelope in accordance with one embodiment of the present disclosure.

Referring now to FIG. 5C, in accordance with one embodiment of the present disclosure, depicts a cross sectional view along line A-A, B-B or C-C of FIG. 2B of a plurality of two fully assembled thermal barrier panels 901, 204 installed and affixed to an building envelope 11 through the engagement of an anchor assembly 203 wherein each thermal barrier panels 204 depicted is constructed and assembled similarly to adjacent panels and to the exploded thermal barrier panels 902, 204 depicted and described in FIG. 5A and where said thermal barrier panels 204 cover a new or existing building envelope 11 with one or more new or existing window assemblies 16 within an opaque wall assembly 14 comprising for example, a mullion or transom 51, and a glazing infill panel 15 with a first exterior side 12 and a second interior side 13 that may made be transparent, translucent or opaque.

The opaque portion of the wall assembly 14 of the new or existing building envelope 11 may be comprised of any opaque material for example, brick, stone, masonry, concrete, metal, wood, composite material, other, etc wherein one or more new or existing window assembly 16 is anchored to create an opening in the opaque portion 14 of the building envelope 11 and wherein the anchor fastener 603 of the thermal barrier panel anchor assembly 203 may penetrate the first and second anchor members 601, 602 and affix to the exterior first side 12 of said opaque wall 14 of building envelope 11 so that the anchor legs 606 and receiver slots 607 may receive the anchor surface or groove 503 of the thermal barrier panel's 204 framing assembly member 600 and create an air cavity 202 as defined by the infill barrier 200, the closure baffle member 506 and the first exterior side 12 of the window assembly 16 and building envelope 11.

Figure 6:
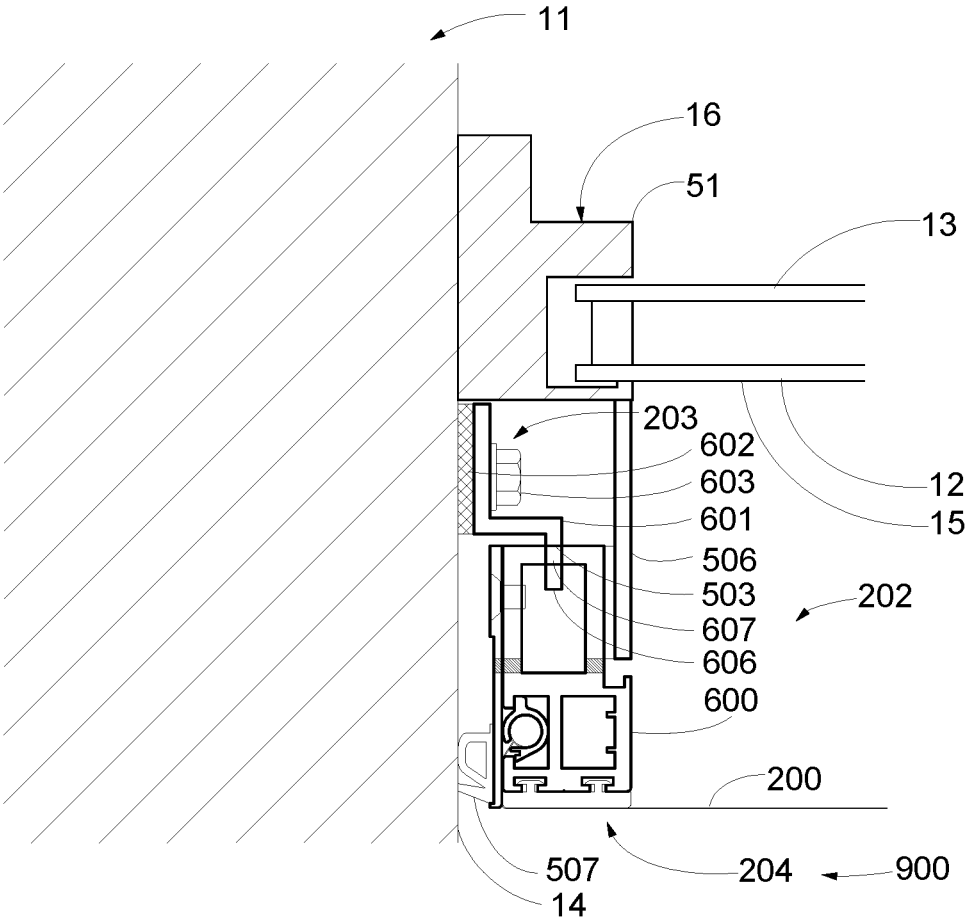
FIG. 6 is a sectional view of a singular thermal barrier panel and an anchor assembly along a horizontal or vertical section, affixed to one side of building wall assembly wherein the thermal barrier panels cover a transparent or translucent glazing assembly within an opening of a building envelope in accordance with one embodiment of the present disclosure.

Referring now to FIG. 6, in accordance with one embodiment of the present disclosure which depicts a vertical or horizontal cross sectional view of a singular, fully assembled thermal barrier panel 900, 204 installed and affixed to an building envelope 11 through the engagement of an anchor assembly 203 wherein the thermal barrier panel 204 depicted is constructed and assembled similarly to the exploded thermal barrier panel 902, 204 depicted and described in FIG. 5A and where said thermal barrier panel 204 cover a new or existing window opening 16 set within the opaque wall assembly 14 comprising for example, a mullion or transom 51, and a glazing infill panel 15 with a first exterior side 12 and a second interior side 13 that may made be transparent, translucent or opaque.

The opaque portion of the wall assembly 14 of the new or existing building envelope 11 may be comprised of any opaque material for example, brick, stone, masonry, concrete, metal, wood, composite material, other, etc, wherein one or more new or existing window assembly 16 is anchored to create an opening in the opaque portion 14 of the building envelope 11 and wherein the anchor fastener 603 of the thermal barrier panel anchor assembly 203 may penetrate the first and second anchor members 601, 602 and affix to the opaque wall 14 of building envelope 11 so that the anchor legs 606 and receiver slots 607 may receive the anchor surface or groove 503 of the thermal barrier panel's 204 framing assembly member 600 and create an air cavity 202 as defined by the infill barrier 200, the closure baffle member 506 and the first exterior side 12 of the window assembly 16 and building envelope 11 wherein the perimeter scaling gasket 507 of the thermal barrier panel 204 engages the adjacent opaque wall 14 of said building envelope 11 creating an air and weather seal that may for example, minimize air and water infiltration and create the air cavity 202 between the infill barrier panel 204 and the first exterior side 12 of the building envelope 11.

Figure 7:
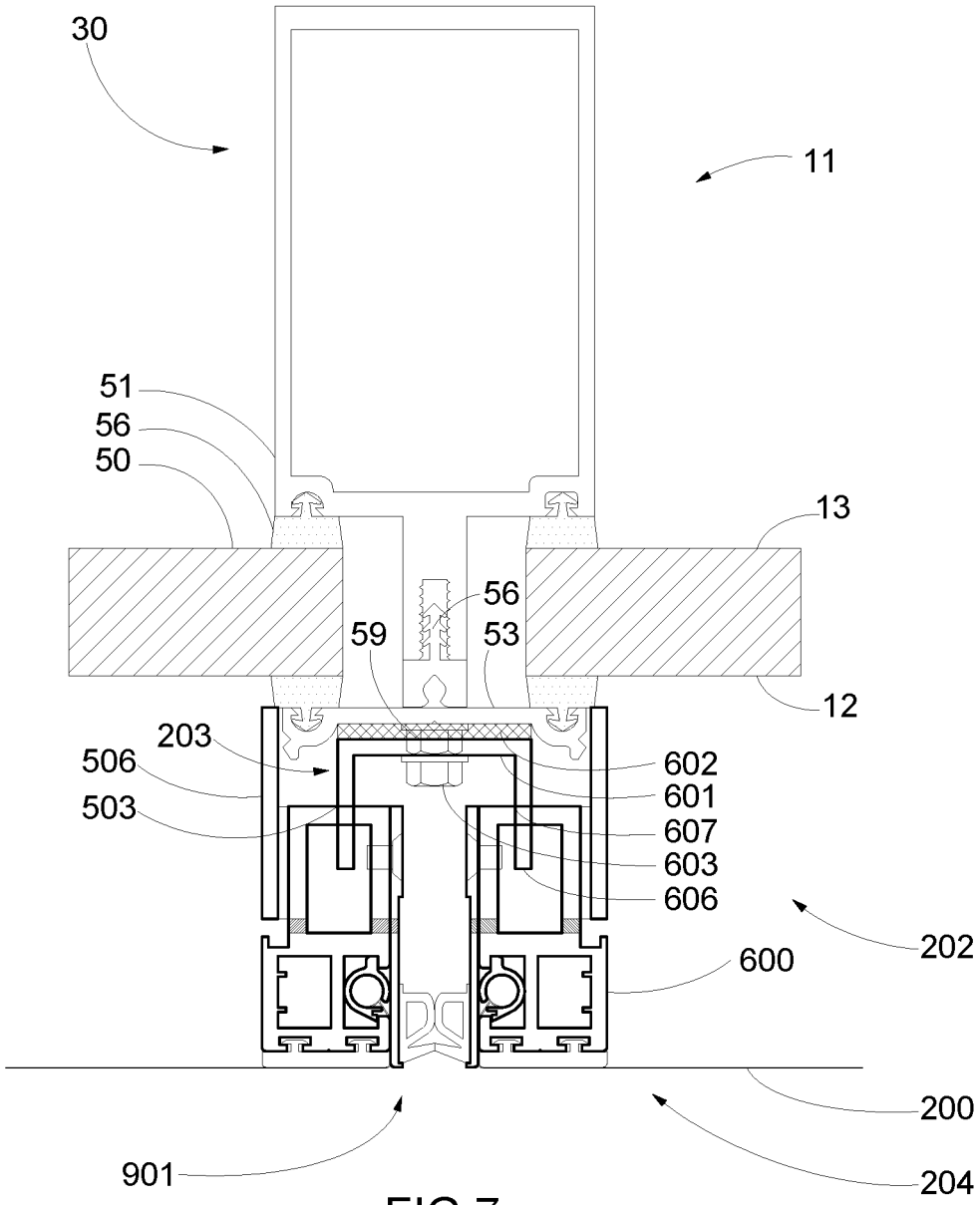
FIG. 7 is a sectional view of a plurality of thermal barrier panels and an anchor assembly along line A-A or B-B of FIG. 2B, affixed to one side of a building curtainwall pressure plate mullion or transom assembly wherein the thermal barrier panels cover the existing curtainwall mullion or transom and rigid sheet-like infill the of a building envelope in accordance with one embodiment of the present disclosure.

Referring now to FIG. 7, in accordance with one embodiment of the present disclosure which depicts a cross sectional view along line A-A or B-B of FIG. 2B of for example, a plurality of two fully assembled thermal barrier panels 901, 204 installed and affixed to a pressure plate curtainwall assembly 30 of a new or existing building envelope 11 through the engagement of a thermal barrier panel anchor assembly 203 wherein each thermal barrier panels 204 depicted is constructed and assembled similarly to adjacent panels and to the exploded thermal barrier panels 902, 204 depicted and described in FIG. 5A and where said thermal barrier panels 204 may cover a new or existing pressure plate curtainwall assembly 30 comprising for example, mullions or transoms 51, curtainwall gaskets 56, pressure plates 53, fasteners 59 and rigid sheet-like panels 50 with a first exterior side 12 and a second interior side 13 that may made be transparent, translucent or opaque as depicted in FIGS. 1A and 1B wherein, the rigid sheet-like panel 50 which may be affixed to the mullions or transoms 51 by said pressure plate 53 in which fasteners 59 penetrate through the pressure plate 53 and into mullions or transoms 51. Curtainwall gaskets 56 are used to separate the rigid sheet-like panel 50 from the mullion or transom 51 and pressure plate 53 and create the pressure plate curtainwall assembly 30.

The thermal barrier panels 204 and anchor assembly 203 may be attached to said pressure plate curtainwall assembly 30 by the anchor fastener 603 of the thermal barrier panel anchor assembly 203 that may penetrate the first and second anchor members 601, 602 and the pressure plate 53 and separation gasket 56 of said pressure plate curtainwall assembly 30 so that the anchor fastener 603 engages the mullion or transom 51 securely affixing said thermal barrier panel anchor assembly 203 to the pressure plate curtainwall assembly 30 wherein the anchor legs 606 and receiver slots 607 may receive the anchor surface or groove 503 of the thermal barrier panel's 204 framing assembly member 600 and create an air cavity 202 as defined by the infill barrier 200, the closure baffle member 506 and the first exterior side 12 of the pressure plate curtainwall assembly 30 and building envelope 11.

Figure 8:
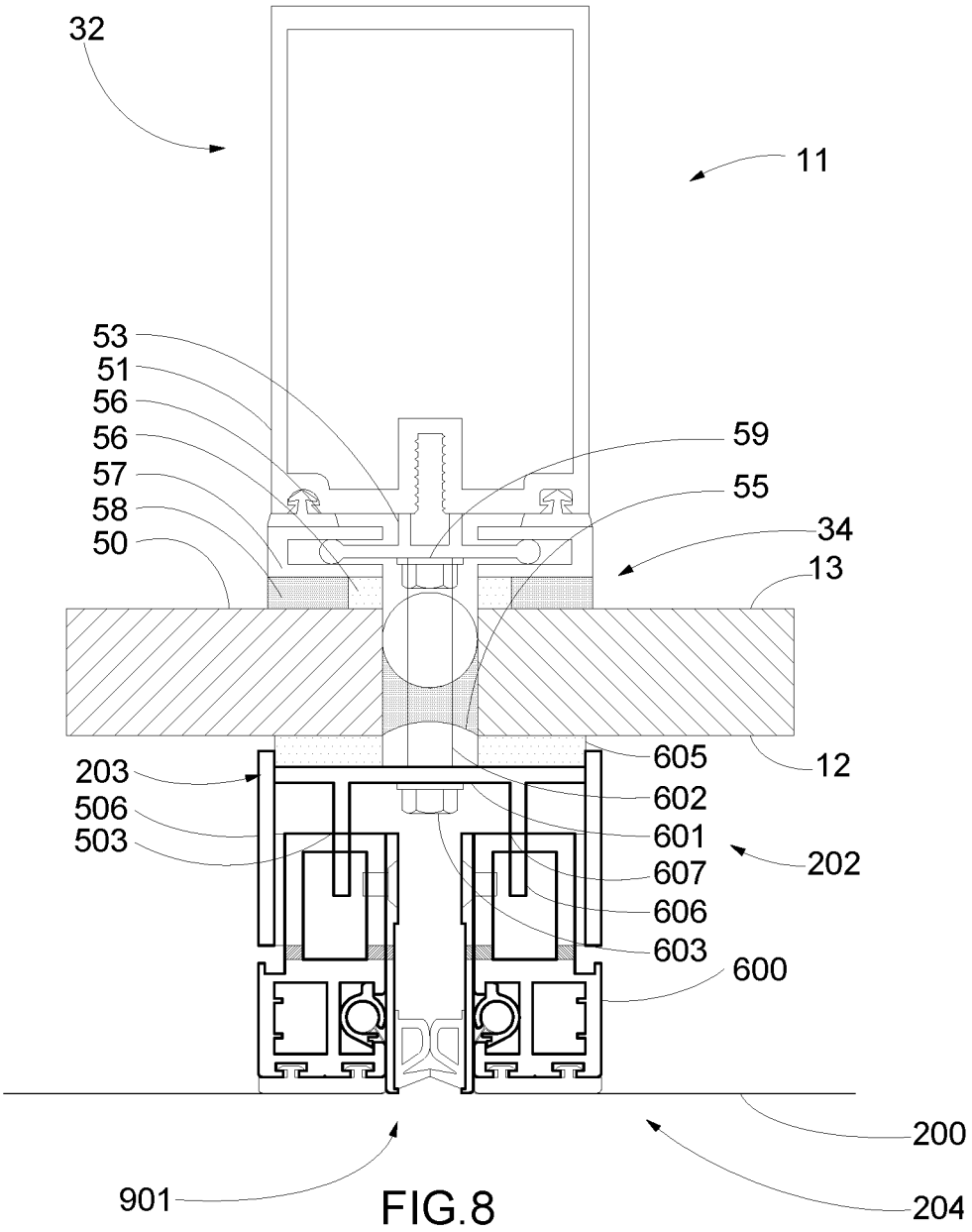
FIG. 8 is a sectional view of a plurality of thermal barrier panels and an anchor assembly along line A-A or B-B of FIG. 2B, affixed to one side of a cassette glazed building curtainwall at a mullion or transom assembly wherein the thermal barrier panels cover the existing curtainwall mullion or transom and rigid sheet-like infill the of a building envelope in accordance with further embodiments of the present disclosure.

Referring now to FIG. 8, in accordance with another embodiment of the present disclosure which depicts a cross sectional view along line A-A or B-B of FIG. 2B of for example, a plurality of two fully assembled thermal barrier panels 901, 204 installed and affixed to a cassette curtainwall assembly 32 of a new or existing building envelope 11 through the engagement of an thermal barrier panel anchor assembly 203 wherein each thermal barrier panels 204 depicted is constructed and assembled similarly to adjacent panels and to the exploded thermal barrier panels 902, 204 depicted and described in FIG. 5A and where said thermal barrier panels 204 cover a new or existing cassette curtainwall assembly 32 comprising for example, mullions or transoms 51, curtainwall gaskets 56, pressure anchors 53, cassette anchor clips 57, adhesive 58, fasteners 59, exposed adhesive 55 and rigid sheet-like panels 50 with a first exterior side 12 and a second interior side 13 that may made be transparent, translucent or opaque as depicted in FIGS. 1A and 1B wherein, the cassette anchor clips 57 may be attached and secured to said rigid sheet-like panel 50 using curtainwall gaskets 56 and structural adhesive 58 to create a cassette sub-panel assembly 34. Said sub-panel 34 may be installed onto the mullions or transoms 51 through engagement and of pressure anchors 53 into the cassette anchor clips 57 adhered to the rigid sheet-like panel 50 which is then secured to the mullions or transoms 51 by fasteners 59 that penetrate the pressure anchor 53 and mullions or transoms 51 wherein an exposed adhesive 55 is applied to seal the perimeter of the sub-panel 34 and mullions or transoms 51 from any air and water infiltration.

The thermal barrier panels 204 and anchor assembly 203 may be attached to said cassette curtainwall assembly 32 wherein the complete or selective removal of the exposed adhesive 55 enables the second anchor member 602 of the thermal barrier panel anchor assembly 203 to penetrate said exposed adhesive 55 and abut to the pressure plate 53 wherein the first anchor member 601, fitted with gaskets 605 to protect said anchor member 601 from the exterior first side 12 of the rigid sheet-like panel 50, is affixed to the cassette curtainwall assembly 32 by the anchor fastener 603 which penetrates the first and second anchor members 601, 602 and mullions or transoms 51 of said cassette curtainwall assembly 32 wherein the anchor legs 606 and receiver slots 607 may receive the anchor surface or groove 503 of the thermal barrier panel's 204 framing assembly member 600 and create an air cavity 202 as defined by the infill barrier 200, the closure baffle member 506 and the first exterior side 12 of the cassette curtainwall assembly 32 and building envelope 11.

Figure 9:
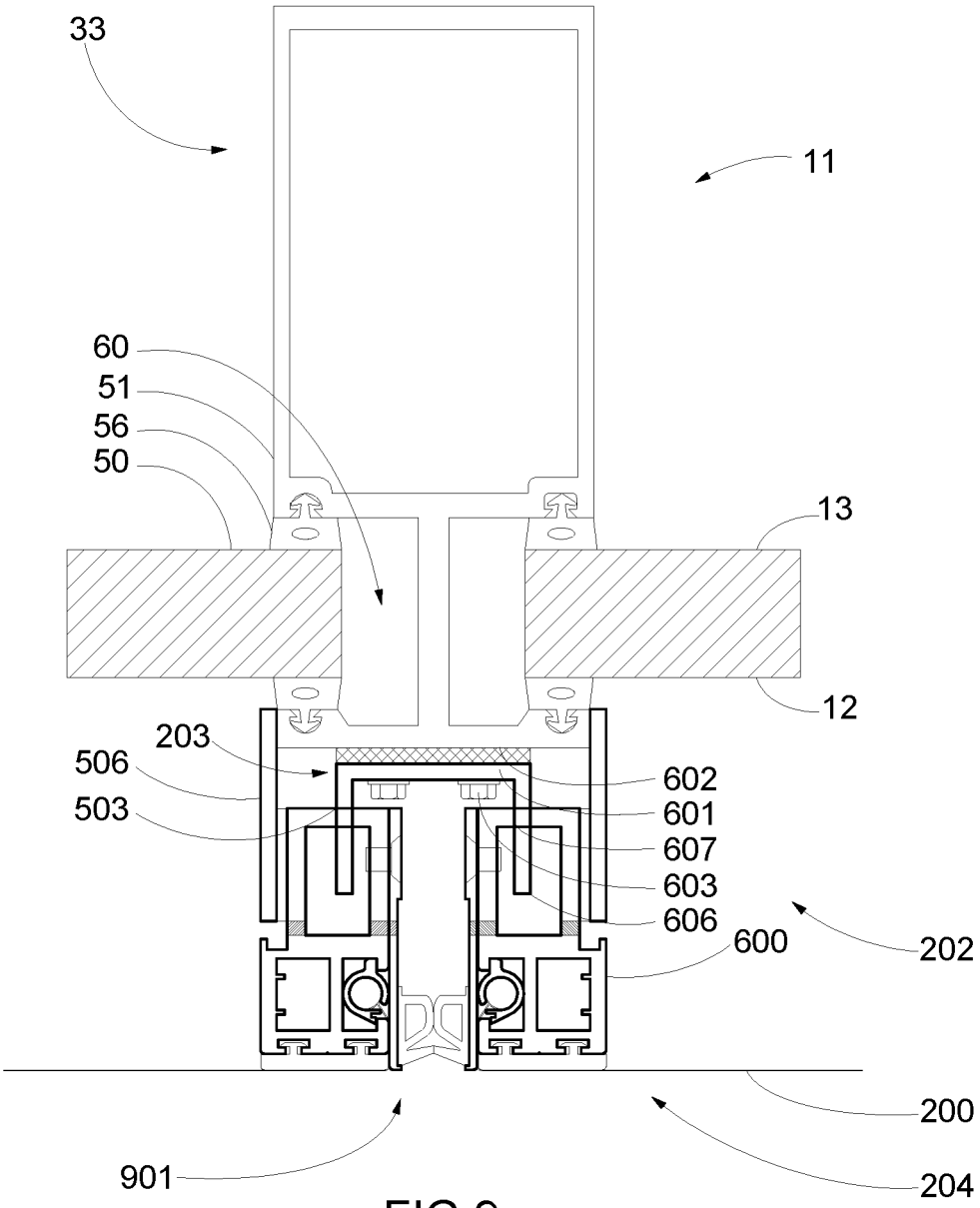
FIG. 9 is a sectional view of a plurality of thermal barrier panels and an anchor assembly along line A-A or B-B of FIG. 2B, affixed to one side of a captured panel curtainwall mullion or transom assembly wherein the thermal barrier panels cover the existing curtainwall mullion or transom and rigid sheet-like infill the of a building envelope in accordance with further embodiments of the present disclosure.

Referring now to FIG. 9, in accordance with another embodiment of the present disclosure which depicts a cross sectional view along line A-A or B-B of FIG. 2B of for example, a plurality of two fully assembled thermal barrier panels 901, 204 installed and affixed to a captured panel curtainwall assembly 33 of a new or existing building envelope 11 through the engagement of an thermal barrier panel anchor assembly 203 wherein each thermal barrier panels 204 depicted is constructed and assembled similarly to adjacent panels and to the exploded thermal barrier panels 902, 204 depicted and described in FIG. 5A and where said thermal barrier panels 204 cover a new or existing captured panel curtainwall assembly 33 comprising for example, mullions or transoms 51, curtainwall gaskets 56, and rigid sheet-like panels 50 with a first exterior side 12 and a second interior side 13 that may made be transparent, translucent or opaque as depicted in FIGS. 1A and 1B wherein, the rigid sheet-like panel 50 which are set into the mullion capture space 60 defined by the geometry of said mullions or transoms 51, gaskets 56 are then installed to secure the rigid sheet-like panel 50 in place.

The thermal barrier panels 204 and anchor assembly 203 may be attached to the captured panel curtainwall assembly 33 by the anchor fastener 603 of the thermal barrier panel anchor assembly 203 that may penetrate the first and second anchor members 601, 602 and penetrate the mullions or transoms 51 securely affixing said thermal barrier panel anchor assembly 203 to the captured panel curtainwall assembly 33 wherein the anchor legs 606 and receiver slots 607 may receive the anchor surface or groove 503 of the thermal barrier panel's 204 framing assembly member 600 and create an air cavity 202 as defined by the infill barrier 200, the closure baffle member 506 and the first exterior side 12 of the captured panel curtainwall assembly 33 and building envelope 11.

Figure 10:
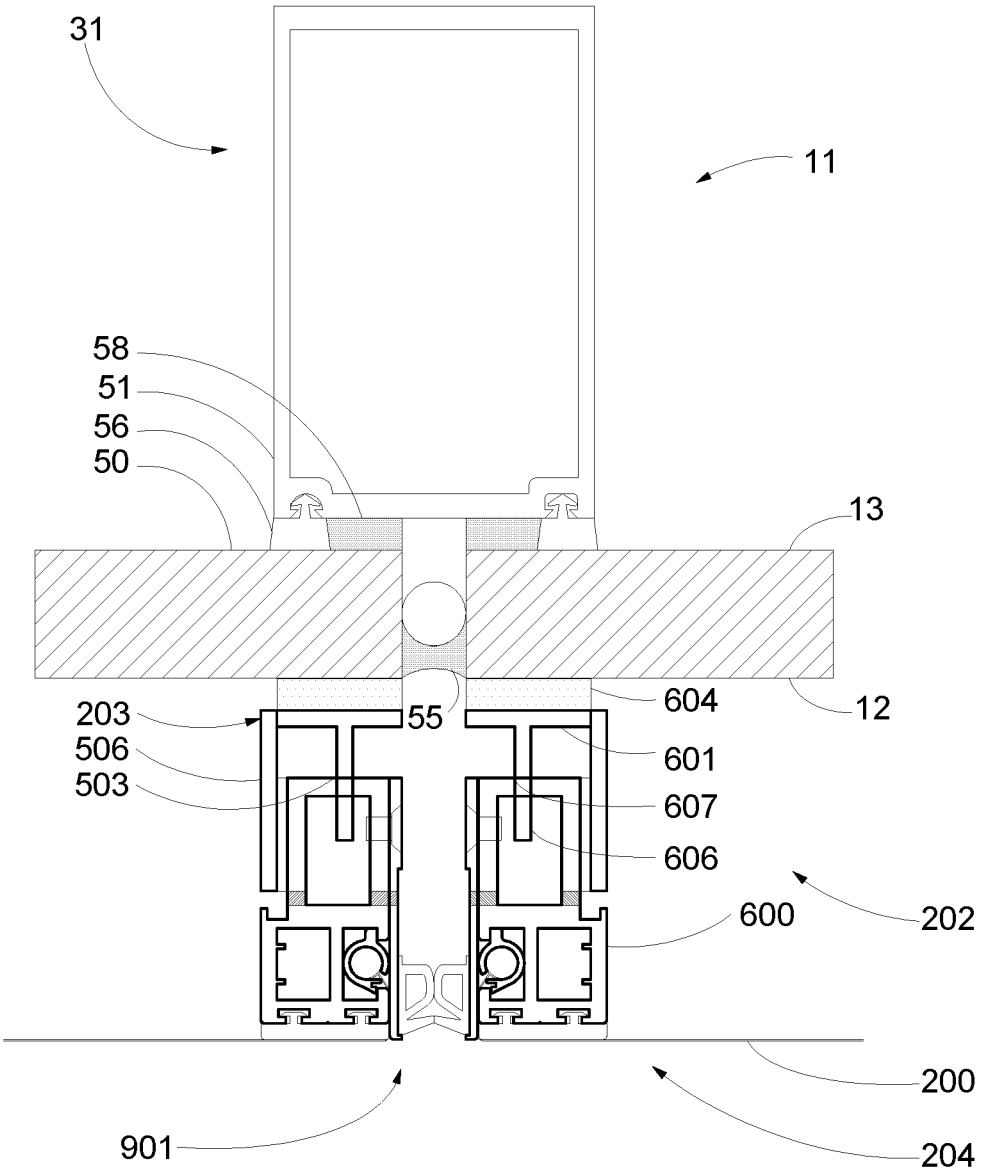
FIG. 10 is a sectional view of a plurality of thermal barrier panels and an anchor assembly along line A-A or B-B of FIG. 2B, affixed to one side of a structural glazed building curtainwall mullion or transom assembly wherein the anchor assembly is affixed to the building envelope's rigid sheet-like infill using adhesive to promote the attachment of the thermal barrier panels to cover the existing curtainwall mullion or transom and rigid sheet-like infill the of a building envelope in accordance with further embodiments of the present disclosure.

Referring now to FIG. 10, in accordance with another embodiment of the present disclosure which depicts a cross sectional view along line A-A or B-B of FIG. 2B of for example, a plurality of two fully assembled thermal barrier panels 901, 204 installed and affixed to a structural glazed curtainwall assembly 31 of a new or existing building envelope 11 through the engagement of an thermal barrier panel anchor assembly 203 wherein each thermal barrier panels 204 depicted is constructed and assembled similarly to adjacent panels and to the exploded thermal barrier panels 902, 204 depicted and described in FIG. 5A and where said thermal barrier panels 204 cover a new or existing structural glazed curtainwall assembly 31 comprising for example, mullions or transoms 51, gaskets 56, structural adhesive 58, exposed adhesive 55 and rigid sheet-like panels 50 with a first exterior side 12 and a second interior side 13 that may made be transparent, translucent or opaque as depicted in FIGS. 1A and 1B wherein, the rigid sheet-like panel 50 is affixed by structural glazed to the mullions or transoms 51 using said gaskets 56 and structural adhesive 58 on the second interior side 13 of the rigid sheet-like panel 50 wherein an exposed adhesive 55 is applied to seal the perimeter of the rigid sheet-like panel 50 and mullions or transoms 51 from air and water infiltration.

The thermal barrier panels 204 and anchor assembly 203 may be attached to the structural glazed curtainwall assembly 31 by affixing the anchor members 601 to the rigid sheet-like panel 50 through adhesive 604 thereby securely affixing said thermal barrier panel anchor assembly 203 to the structural glazed curtainwall assembly 31 wherein the anchor legs 606 and receiver slots 607 may receive the anchor surface or groove 503 of the thermal barrier panel's 204 framing assembly member 600 and create an air cavity 202 as defined by the infill barrier 200, the closure baffle member 506 and the first exterior side 12 of the structural glazed curtainwall assembly 31 and building envelope 11

Figure 11:
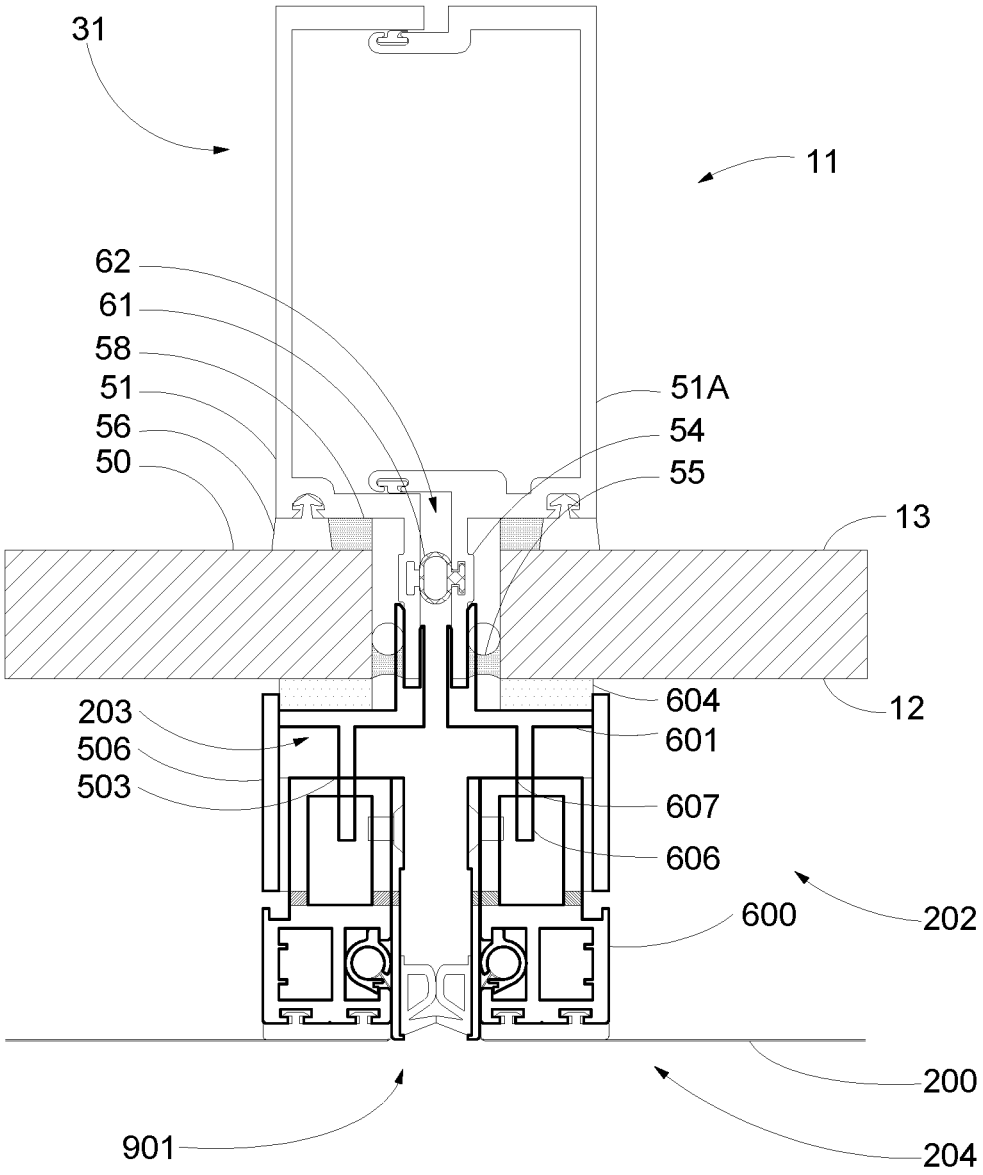
FIG. 11 is a sectional view of a plurality of thermal barrier panels and an anchor assembly along line A-A or B-B of FIG. 2B, affixed to one side of a structural glazed building curtainwall mullion or transom assembly wherein the anchor assembly is affixed using mechanical or adhesive to the exposed edge extrusion of building envelope mullion or transom to promote the attachment of the thermal barrier panels to cover the existing curtainwall mullion or transom and rigid sheet-like infill the of a building envelope in accordance with further embodiments of the present disclosure.

Referring now to FIG. 11, in accordance with another embodiment of the present disclosure which depicts a cross sectional view along line A-A or B-B of FIG. 2B of for example, a plurality of two fully assembled thermal barrier panels 901, 204 installed and affixed to a structural glazed curtainwall assembly 31 at a movement joint 62 of a new or existing building envelope 11 through the engagement of an thermal barrier panel anchor assembly 203 wherein each thermal barrier panels 204 depicted is constructed and assembled similarly to adjacent panels and to the exploded thermal barrier panels 902, 204 depicted and described in FIG. 5A and where said thermal barrier panels 204 cover a new or existing structural glazed curtainwall assembly 31 comprising for example, mullions or transoms 51, 51A, edge extrusions 54, gaskets 56, weather gasket 61, movement joint 62, structural adhesive 58, exposed adhesive 55 and rigid sheet-like panels 50 with a first exterior side 12 and a second interior side 13 that may made be transparent, translucent or opaque as depicted in FIGS. 1A and 1B wherein, the rigid sheet-like panel 50 is affixed by structural glazed to the mullions or transoms 51, 51A using said gaskets 56 and structural adhesive 58 on the second interior side 13 of the rigid sheet-like panel 50 wherein an exposed adhesive 55 is applied to seal the perimeter of the rigid sheet-like panel 50 and edge extrusions 54 of said mullions or transoms 51, 51A from air and water infiltration. Additional protection from air and water infiltration may be achieved by implementing additional weather gaskets 61 at movement joints 62 within the mullions or transoms 51, 51A of the structural glazed curtainwall assembly 31.

The thermal barrier panels 204 and anchor assembly 203 may be attached to the exterior of the said structural glazed curtainwall assembly 31 by selectively removing portions of the exposed adhesive 55 at the perimeter of the rigid sheet-like panel 50 to promote the engagement of the edge extrusions 54 by for example, pressure fitting, adhesive, crimping, clamping or other mechanical means, wherein the anchor members 601 may be additionally secured to the rigid sheet-like panel 50 through adhesive 604 thereby affixing said thermal barrier panel anchor assembly 203 to the structural glazed curtainwall assembly 31 wherein the anchor legs 606 and receiver slots 607 may receive the anchor surface or groove 503 of the thermal barrier panel's 204 framing assembly member 600 and create an air cavity 202 as defined by the infill barrier 200, the closure baffle member 506 and the first exterior side 12 of the structural glazed curtainwall assembly 31 and building envelope 11

Figure 12:
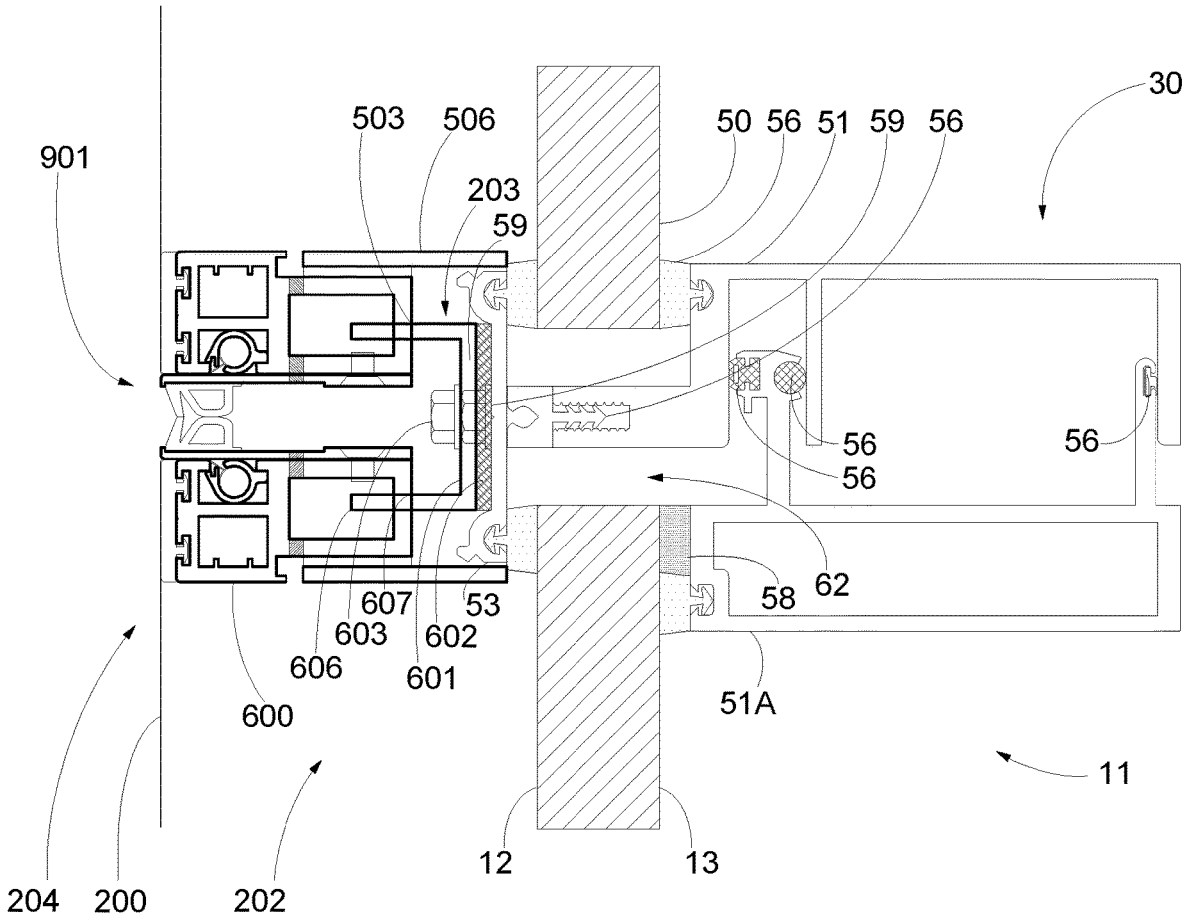
FIG. 12 is a sectional view of a plurality of thermal barrier panels along line A-A of FIG. 2B, affixed to one side of a building curtainwall pressure plate transom movement joint assembly wherein the thermal barrier panels cover the existing curtainwall mullion or transom and rigid sheet-like infill the of a building envelope in accordance with further embodiments of the present disclosure.

Referring now to FIG. 12, in accordance with another embodiment of the present disclosure which depicts a cross sectional view along line B-B of FIG. 2B of for example, a plurality of two fully assembled thermal barrier panels 901, 204 installed and affixed to a pressure plate curtainwall assembly 30 at a movement joint 62 of a new or existing building envelope 11 through the engagement of an thermal barrier panel anchor assembly 203 wherein each thermal barrier panels 204 depicted is constructed and assembled similarly to adjacent panels and to the exploded thermal barrier panels 902, 204 depicted and described in FIG. 5A and where said thermal barrier panels 204 cover a new or existing pressure plate curtainwall assembly 30 comprising for example, mullions or transoms 51, 51A, curtainwall gaskets 56, movement joint 62, pressure plates 53, fasteners 59, adhesive 58 and rigid sheet-like panels 50 with a first exterior side 12 and a second interior side 13 that may made be transparent, translucent or opaque as depicted in FIGS. 1A and 1B wherein, the rigid sheet-like panel 50 which may be affixed to the mullions or transoms 51 by said pressure plate 53 in which fasteners 59 penetrate through the pressure plate 53 and into mullions or transoms 51. Curtainwall gaskets 56 are used to separate the rigid sheet-like panel 50 from the mullion or transom 51, 51A and pressure plate 53 and create the pressure plate curtainwall assembly 30 at a movement joint 62.

The thermal barrier panels 204 and anchor assembly 203 may be attached to said pressure plate curtainwall assembly 30 by the anchor fastener 603 of the thermal barrier panel anchor assembly 203 that may penetrate the first and second anchor members 601, 602 and penetrate the pressure plate 53 and separation gasket 56 of said pressure plate curtainwall assembly 30 so that the anchor fastener 603 engages the mullion or transom 51 securely affixing said thermal barrier panel anchor assembly 203 to the pressure plate curtainwall assembly 30 wherein the anchor legs 606 and receiver slots 607 may receive the anchor surface or groove 503 of the thermal barrier panel's 204 framing assembly member 600 and create an air cavity 202 as defined by the infill barrier 200, the closure baffle member 506 and the first exterior side 12 of the pressure plate curtainwall assembly 30 and building envelope 11.

Figure 13:
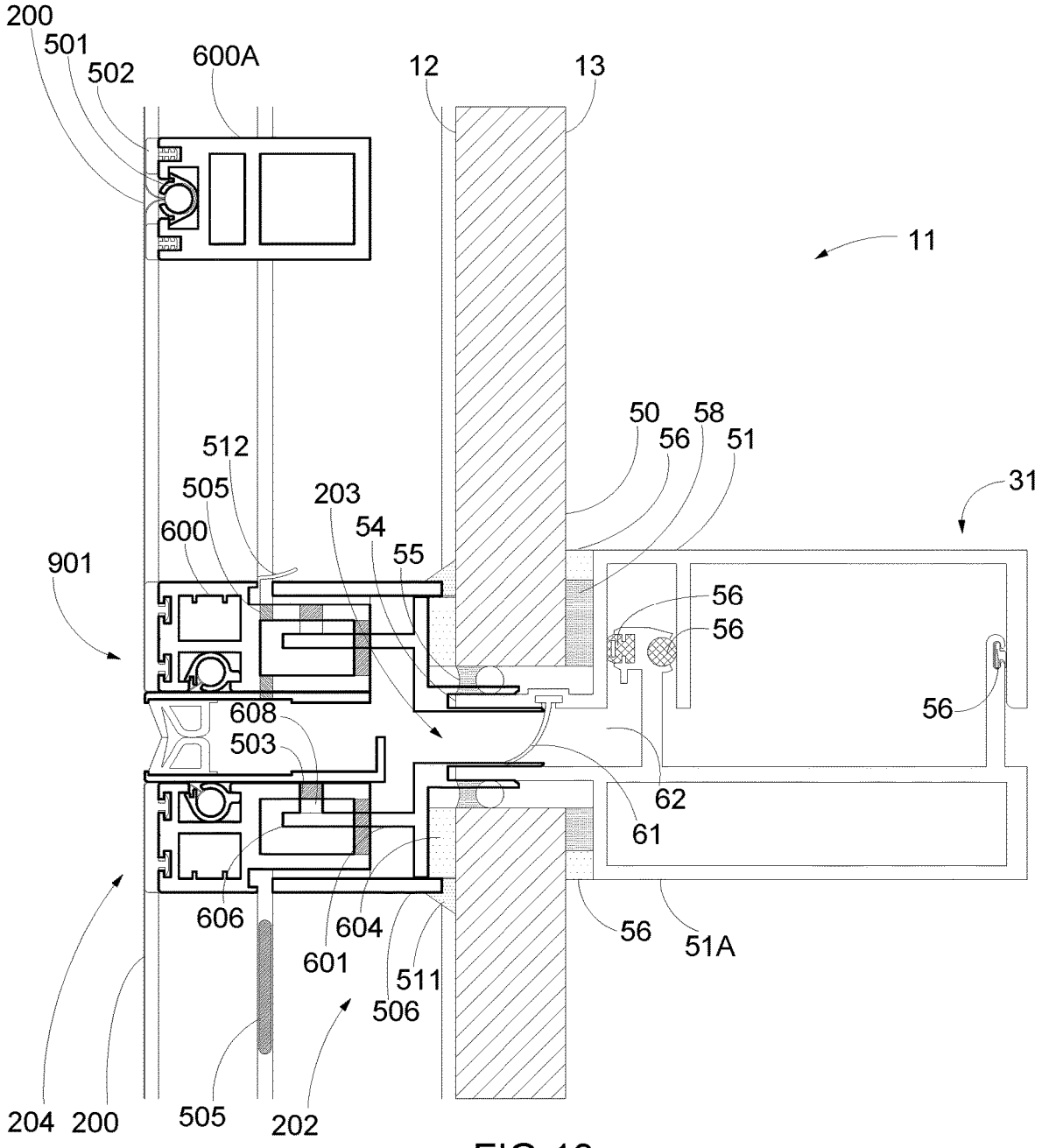
FIG. 13 is a sectional view of a plurality of thermal barrier panels along line A-A of FIG. 2B, affixed to one side of a structural glazed building curtainwall transom movement joint assembly wherein the thermal barrier panels cover the existing curtainwall mullion or transom and rigid sheet-like infill the of a building envelope in accordance with further embodiments of the present disclosure.

Referring now to FIG. 13, in accordance with another embodiment of the present disclosure which depicts a cross sectional view along line B-B of FIG. 2B of for example, a plurality of two fully assembled thermal barrier panels 901, 204 installed and affixed to a structural glazed curtainwall assembly 31 at a movement joint 62 of a new or existing building envelope 11 through the engagement of an thermal barrier panel anchor assembly 203 wherein each thermal barrier panels 204 depicted is constructed and assembled similarly to adjacent panels and to the exploded thermal barrier panels 902, 204 depicted and described in FIG. 5A with additional components comprising, a secondary thermal barrier mullion or transom 600A to support and provide addition fixity of the infill barrier 200 by engaging a pressure fitting 501 into said secondary mullion or transom 600A in which buffer gaskets 502 hold infill barrier 200 from the secondary mullion or transom 600A, a vent baffle 512 to manage flow of air from air cavity 202 through the vent penetration 505, and closure baffle gasket 511 wherein said thermal barrier panels 204 cover a new or existing structural glazed curtainwall assembly 31 comprising for example, mullions or transoms 51, 51A, edge extrusions 54, gaskets 56, weather gasket 61, movement joint 62, structural adhesive 58, exposed adhesive 55 and rigid sheet-like panels 50 with a first exterior side 12 and a second interior side 13 that may made be transparent, translucent or opaque as depicted in FIGS. 1A and 1B wherein, the rigid sheet-like panel 50 is affixed by structural glazed to the mullions or transoms 51, 51A using said gaskets 56 and structural adhesive 58 on the second interior side 13 of the rigid sheet-like panel 50 wherein an exposed adhesive 55 is applied to seal the perimeter of the rigid sheet-like panel 50 and edge extrusions 54 of said mullions or transoms 51, 51A from air and water infiltration. Additional protection from air and water infiltration may be achieved by implementing additional weather gaskets 61 at movement joints 62 within or between the mullions or transoms 51, 51A of the structural glazed curtainwall assembly 31.

The thermal barrier panels 204 and anchor assembly 203 may be attached to the structural glazed curtainwall assembly 31 by selectively removing portions of the exposed adhesive 55 at the perimeter of the rigid sheet-like panel 50 to promote the engagement of the edge extrusions 54 by the anchor members 601 through, for example, pressure fitting, adhesive, crimping, clamping or other means, wherein said anchor members 601 may also be additionally secured to the rigid sheet-like panel 50 through adhesive 604 thereby affixing said thermal barrier panel anchor assembly 203 to the structural glazed curtainwall assembly 31 wherein the anchor leg 606 of said anchor members 601 may be fitted with a hinge mechanism 608 and is received by anchor surface or groove 503 of the thermal barrier panel's 204 framing assembly member 600 thereby anchoring the thermal barrier panel 204 to the structural glazed curtainwall assembly 31 wherein said barrier panel 204 creates an air cavity 202 as defined by the infill barrier 200, the closure baffle member 506 coupled with a compression gasket 511, and the first exterior side 12 of the structural glazed curtainwall assembly 31 and building envelope 11 and wherein the hinge mechanism 608 of the anchor assembly 203 may promote the operation of thermal barrier panels 204 to gain access to or ventilation of the air cavity 202 and the first exterior side 12 of the structural glazed curtainwall assembly 31 and building envelope 11.

Figure 14A:
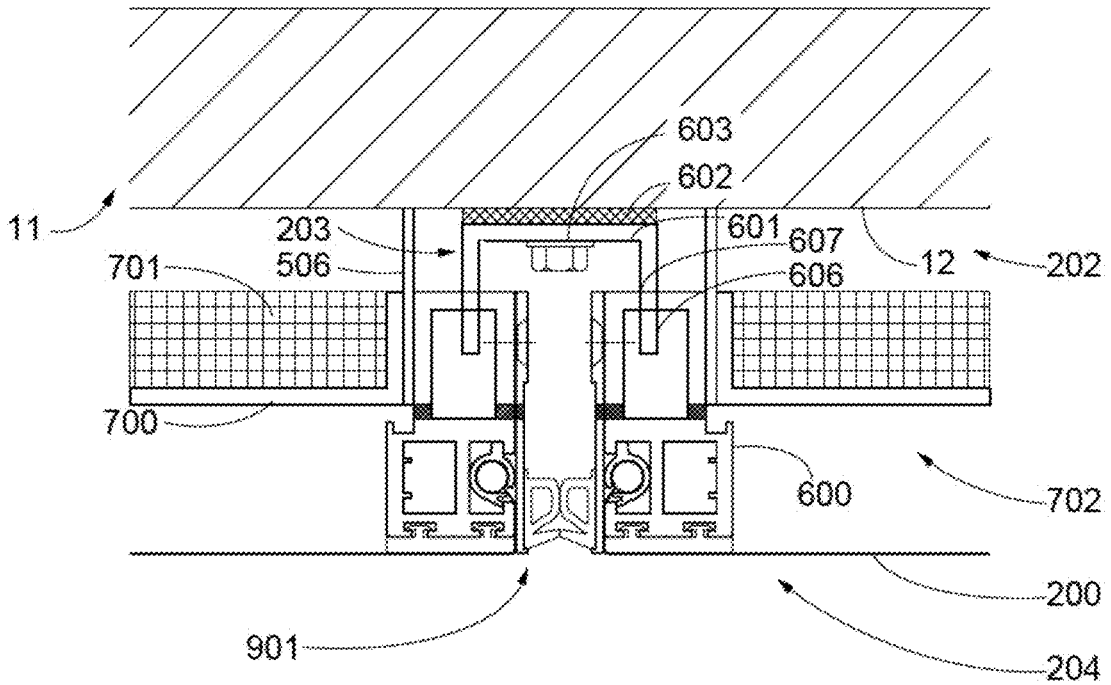
FIG. 14A is a sectional view of a plurality of thermal barrier panels and an anchor assembly along line A-A or B-B or C-C of FIG. 2B, affixed to one side of a building wall assembly wherein the thermal barrier panels comprising at least one additional infill barrier of rigid sheet-like material wherein the thermal barrier panels cover an opaque, transparent or translucent wall assembly of a building envelope in accordance with further embodiments of the present disclosure.

Referring now to FIG. 14A, in accordance with another embodiment of the present disclosure which depicts a horizontal or vertical cross section of for example, a plurality 901 of two fully assembled thermal barrier panels 204 installed and affixed to a building envelope 11 through the engagement of an anchor assembly 203 wherein each thermal barrier panels 204 depicted may be identical in composition and assembly in composition and assembly to adjacent panels and to the exploded thermal barrier panels 902, 204 depicted and described in FIG. 5A with additional components comprising, for example, an additional rigid sheet-like panel 700, additional insulation 701, and an additional enclosed air cavity 702 wherein said thermal barrier panels 204 are assembled as depicted in FIG. 5A, said rigid sheet-like panel 700 is affixed to the framing assembly member 600, said insulation 701 is affixed to the rigid sheet-like panel 700 thereby creating an enclosed air cavity 702 between the infill barrier 200 and the rigid sheet-like panel 700 within the thermal barrier panels 204.

The wall assembly of the new or existing building envelope 11 is for example, to be considered generic but may be comprised of any opaque material for example, brick, stone, masonry, concrete, metal, wood, composite material, glazing system, other, etc, wherein the anchor fastener 603 or the thermal barrier panel anchor assembly 203 may penetrate the first and second anchor members 601, 602 and affix to the exterior first side 12 of said building envelope 11 so that the anchor legs 606 and receiver slots 607 may receive the anchor surface or groove 503 of the thermal barrier panel's 204 framing assembly member 600 and create an air cavity 202 as defined by the rigid sheet-like panel 700 within the thermal barrier panels 204, the closure baffle members 506 and the first exterior side 12 of the building envelope 11.

Figure 14B:
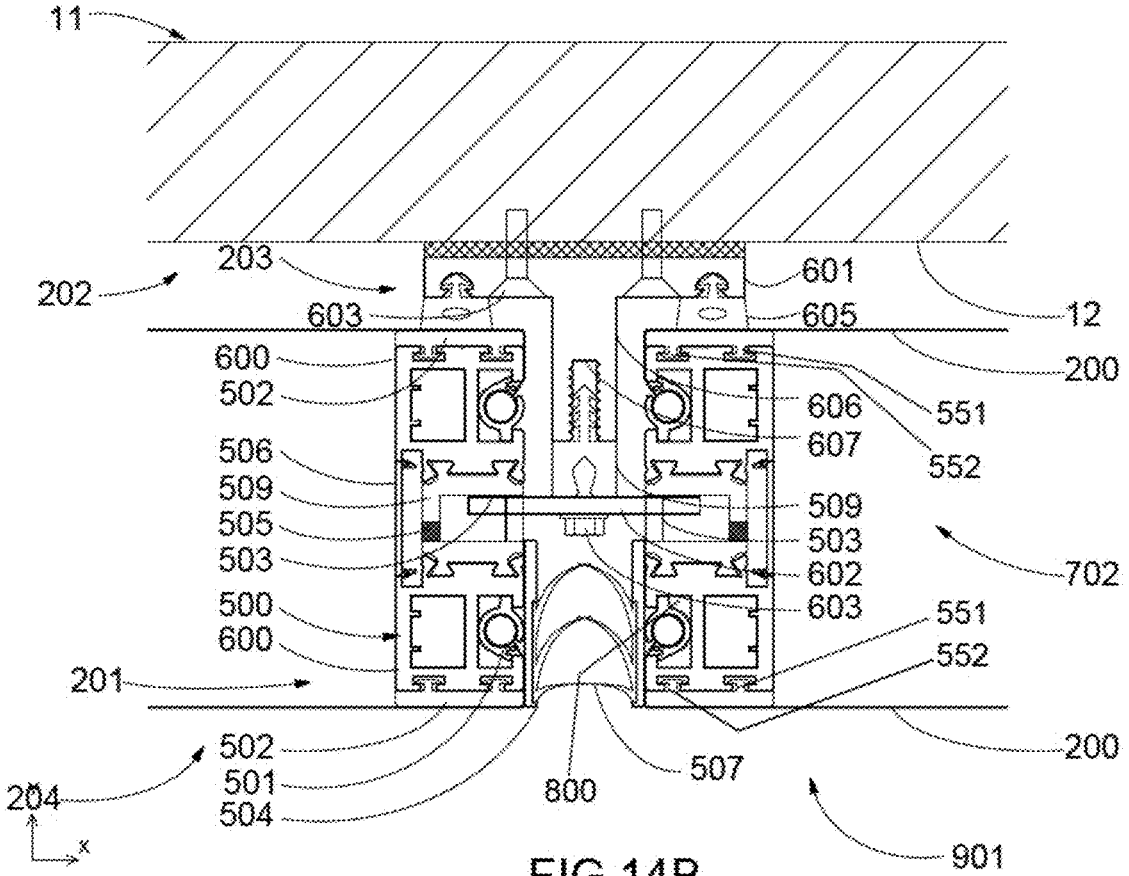
FIG. 14B is a sectional view of a plurality of thermal barrier panels and an anchor assembly along line A-A or B-B or C-C of FIG. 2B, affixed to one side of a building wall assembly wherein the thermal barrier panels comprising a mullion or transom assembly configured to receive at least two infill barriers to create an enclosed cavity wherein the thermal barrier panels cover an opaque, transparent or translucent wall assembly of a building envelope in accordance with further embodiments of the present disclosure.

Referring now to FIG. 14B, in accordance with another embodiment of the present disclosure which depicts a horizontal or vertical cross section of for example, a plurality 901 of two fully assembled thermal barrier panels 204 installed and affixed to a building envelope 11 through the engagement of an anchor assembly 203 wherein the thermal barrier panels 204 comprising, for example, two infill barriers 200 where one or more edges of the infill barriers 200 are fitted with a pressure fitting 501 prior to installation onto the panel frame assembly 201 and the panel frame assembly 201 which may be constructed as a separate frame unit comprising two or more assembly mullions or transoms 500 comprising, for example, two rigid framing member 600 affixed and joined to one another by a thermal isolator 509 by for example, a crimping fixity and trimmed with a closure baffle 506 wherein said mullions or transoms 500 may be cut, drilled, slotted, grooved, knurled, or any such process required prior to frame assembly, after which, said primary rigid framing member 600 are affixed to one another by using for example, mechanical fasteners, corner keys, adhesives, crimping techniques or other means of connection, etc. Once said rigid framing members 600 are joined in a panel framing assembly 201 the following components may be cut, shaped, and affixed to said rigid framing members 600 in the configuration of the frame as defined by the number and shape of said rigid framing members 600 wherein for example, two buffer gasket 502 engage the cross section of the rigid framing members 600 to protect and separate the infill barriers 200 from the rigid framing member 600 completing the overall panel framing assembly 201 after which, the infill barriers 200 are affixed to the rigid framing members 600 of said panel framing assembly 201 by engaging pressure fitting 501 into the cross section of one or more rigid framing member 600 resulting in two stretched membrane infill barrier 200 spanning across the panel frame assembly 201 creating an enclosed cavity 702.

Once the infill barriers 200 are installed, the perimeter trim member 504 comprising a rigid material for example, metal, plastic, composite or other, etc. with a perimeter sealing gasket 507 affixed, may be attached to the rigid framing members 600 through mechanical fixity wherein the perimeter trim member 504 covers the engaged pressure fitting 501 of the infill barrier 200 edge.

Prior to panel installation on the building envelope 11, the anchor assembly 203 may be mounted first. In FIG. 14B, the wall assembly of the new or existing building envelope 11 is for example, to be considered generic but may be comprised of any opaque material for example, brick, stone, masonry, concrete, metal, wood, composite material, glazing system, or other, etc, wherein the anchor fastener 603 or the thermal barrier panel anchor assembly 203 may penetrate the first anchor member 601 and affix to the exterior first side 12 of said building envelope 11, said first anchor member 601 may have gaskets 605 affixed to protect the thermal barrier panels 204. Once said first anchor member 601 is affixed to the building envelope 11, the thermal barrier panels 204 may be installed wherein said thermal barrier panels 204 are set onto the anchor gaskets 605 and the second anchor member 602 is fastened onto the receiver slot 607 of the first anchor member's 601 anchor leg 606 and thermal isolator 509 by an anchor fastener 603, said second anchor member 602 may receive the anchor surface or groove 503 of the thermal barrier panel's 204 assembly mullions or transoms 500 and create an air cavity 202 as defined by the thermal barrier panel 204, and the first exterior side 12 of the building envelope 11. Once said thermal barrier panel 204 is installed on the anchor assembly 203 in a panel plurality 901 the perimeter sealing gasket 507 of each adjacent thermal barrier panel 204 create an air and weather seal that may for example, minimize air and water infiltration and create the air cavity 202 between the infill barrier panel 204 and the first exterior side of the building envelope 11 as defined by the outer most surface of the stretched membrane ETFE infill barrier 200 across to the first exterior side 12 of the new or existing building envelope.

Heat buildup within the enclosure air cavity 702 may flow through the vent penetrations 505 of the panel frame assembly 201 and exit to the exterior. Additional vent penetrations 505 may be located to promote controlled ventilation of said air cavity 202 as well as the shape and location of said perimeter sealing gasket may be adjusted to promote the transfer of cavity air to the exterior while minimizing air and water infiltration into said air cavity 202.

Referring now to FIG. 15, in accordance with another embodiment of the present disclosure which depicts a horizontal or vertical cross section of for example, a plurality 901 of two fully assembled thermal barrier panels 204 installed and affixed to a mullion or transom 51 of a pressure plate curtainwall assembly 30 of a new or existing building envelope 11 through the engagement of the pressure plate 53 acting as a primary building enclosure wherein each thermal barrier panel 204 depicted comprising, for example, an infill barriers 200 where one of said one or more edges of the infill barrier 200 are fitted with a pressure fitting 501 prior to installation onto the panel frame assembly 201 and the panel frame assembly 201 which may be constructed as a separate frame unit comprising two or more assembly mullions or transoms 500 comprising, for example, a rigid framing member 600 wherein said mullions or transoms 500 may be cut, drilled, slotted, grooved, knurled, or any such process required prior to frame assembly, after which said primary rigid framing member 600 may be affixed to one another by using, for example, mechanical fasteners, corner keys, adhesives, crimping techniques or other means of connection, etc. Once said rigid framing members 600 are joined in a frame the following components are cut, shaped, and affixed to said rigid framing members 600 in the configuration of the frame as defined by the number and shape of said rigid framing members 600 wherein the buffer gasket 502 engages the cross section of the rigid framing members 600 to protect and separate the infill barrier 200 from the rigid framing member 600 completing the overall panel framing assembly 201 after which, a rigid sheet-like panel 700 comprising for example, glass, metal, wood, composite material, other, etc. may be cut and shaped to match the size of the panel framing assembly 201 and is adhered to the rigid framing members 600 or said panel framing assembly 201 using adhesive 604 or other mechanical fixity.

Once the rigid sheet-like panel 700 is affixed to the panel framing assembly 201 the infill barrier 200 may be attached to the rigid framing members 600 of said panel framing assembly 201 by engaging pressure fitting 501 previously connected to one or more edges of the infill barrier 200 into the cross section of one or more rigid framing member 600 creating for example, an enclosed air cavity 702 as defined by said infill barrier 200 and the rigid sheet-like panel 700 thereby defining another embodiment of the thermal barrier panel 204. Said thermal barrier panels 204 may be installed onto mullions or transoms 51 of a curtainwall assembly 30 of a new or existing building envelope 11 through the engagement of the pressure plate anchor 53, wherein the interior second side 13 of the thermal barrier panels 204 may be set onto the buffer gaskets 56 engaged in said mullions or transoms 51 such that pressure plate anchor 53 comprising separation gaskets 56 engages the first exterior side 12 of the thermal barrier panel 204 wherein the pressure plate fastener 59 passes through said pressure plate anchor 53 into the mullions or transoms 51 of a curtainwall assembly 30 to anchor the thermal barrier panel 204 wherein a pressure plate cover cap 52 is attached to said pressure plate anchor 53 thereby creating the primary barrier to the new or existing building envelope 11

Referring now to FIG. 16A, in accordance with one embodiment of the present disclosure illustrates, horizontal or vertical cross section of the mullion or transom assembly 500 of a thermal barrier panel 204 as depicted and described in FIG. 5A wherein the mullion or transom assembly 500 comprising for example, a single rigid framing member 600 that may be comprised of any rigid material for example, aluminum, steel, fiberglass, polymer, composite, other, etc. and cross-sectional geometry may be any shape to promote the use and function of said mullion or transom assembly 500

Referring now to FIG. 16B, in accordance with another embodiment of the present disclosure, illustrates horizontal or vertical cross section of the mullion or transom assembly 500 of a thermal barrier panel 204 as depicted and described in FIG. 5A wherein the mullion or transom assembly 500 comprising for example, a rigid framing member 600 that may be comprised of a rigid material for example, aluminum, steel, etc. and a thermal isolator 509 that may be comprised of a rigid material, for example fiberglass, polymer, composite, other, etc. and cross-sectional geometry may be any shape to promote the use and function of said mullion or transom assembly 500. The components of said mullion or transom assembly 500 may be joined by using, for example, mechanical fasteners, adhesives, crimping techniques or other means of connection.

Referring now to FIG. 16C, in accordance with another embodiment of the present disclosure, illustrates horizontal or vertical cross section of the mullion or transom assembly 500 of a thermal barrier panel 204 as depicted and described in FIG. 5A wherein the mullion or transom assembly 500 comprising for example, two rigid framing members 600 that may be comprised of a rigid material for example, aluminum, steel, etc. and two thermal isolators 509 that may be comprised of a rigid material, for example fiberglass, polymer, composite, other, etc, wherein two rigid framing members 600 may be joined together for example, by thermal isolators 509 by using, for example, mechanical fasteners, adhesives, crimping techniques or other means of connection wherein the cross-sectional geometry of said framing members 600 and thermal isolators 509 may be any shape or form to promote the use and function of said mullion or transom assembly 500.

Referring now to FIG. 16D, in accordance with further embodiment of the present disclosure illustrates, horizontal or vertical cross section mullion or transom assembly 500 of a thermal barrier panel 204 as depicted and described in FIG. 5A wherein the mullion or transom assembly 500 comprising a single rigid framing member 600 that may be comprised of any rigid material for example, aluminum, steel, fiberglass, polymer, composite, other, etc. and cross-sectional geometry may be any shape to promote the use and function of said mullion or transom assembly 500.

Referring now to FIG. 16E, in accordance with further embodiment of the present disclosure, illustrates horizontal or vertical cross section of the mullion or transom assembly 500 of a thermal barrier panel 204 as depicted and described in FIG. 5A wherein the mullion or transom assembly 500 comprising a rigid framing member 600 that may be comprised of a rigid material for example, aluminum, steel, etc. and a thermal isolator 509 that may be comprised of a rigid material, for example fiberglass, polymer, composite, other, etc. and cross-sectional geometry may be any shape to promote the use and function of said mullion or transom assembly 500. The components of said mullion or transom assembly 500 may be joined by using, for example, mechanical fasteners, adhesives, crimping techniques or other means of connection.

Referring now to FIG. 16F, in accordance with further embodiment of the present disclosure, illustrates horizontal or vertical cross section of the mullion or transom assembly 500 of a thermal barrier panel 204 as depicted and described in FIG. 5A wherein the mullion or transom assembly 500 comprising a rigid framing member 600 that may be comprised of a rigid material for example, aluminum, steel, etc and a thermal isolator 509 that may be comprised of a rigid material, for example fiberglass, polymer, composite, other, etc. and cross-sectional geometry may be any shape to promote the use and function of said mullion or transom assembly 500. The components of said mullion or transom assembly 500 may be joined by using, for example, mechanical fasteners, adhesives, crimping techniques or other means of connection. Referring now to FIG. 17A, in accordance with another embodiment of the present disclosure, illustrates horizontal or vertical cross section of the panel frame assembly 201 of a thermal barrier panel 204 as depicted and described in FIG. 5A wherein the cross-sectional geometry of the pressure fitting 501 is such that when engaged into a receiver slot 800 of the rigid framing member 600 a leg 801 of the perimeter trim member 504 may engage the receiver slot 800 and said pressure fitting 501 to affix the infill barrier 200 to the panel frame assembly 201.

Referring now to FIG. 17B, in accordance with another embodiment of the present disclosure, illustrates a horizontal or vertical cross section or the panel frame assembly 201 of a thermal barrier panel 204 as depicted and described in FIG. 5A wherein the infill barrier 200 is not required to have any pressure fittings affixed to the edges of said infill barrier 200 prior to mounting to the panel frame assembly 201, rather the edges of the infill barrier 200 may be affixed to the rigid framing member 600 wherein the pressure fitting 501 may have a cross-sectional geometry such that said pressure fitting 501 affixes the infill barrier 200 between the pressure fitting 501 and rigid framing member 600 within the receiver slot 800 of said rigid framing member 600, wherein the perimeter trim member 504 may be affixed to the rigid framing member 600 by the engagement of the perimeter trim member leg 801 and pressure fitting 501 further securing the infill barrier 200 to the panel frame assembly 201.

Referring now to FIG. 17C, in accordance with another embodiment of the present disclosure, illustrates a horizontal or vertical cross section or the panel frame assembly 201 of a thermal barrier panel 204 as depicted and described in FIG. 5A wherein the infill barrier 200 is not required to have any pressure fittings affixed to the edges of said infill barrier 200 prior to mounting to the panel frame assembly 201, rather the edges of the infill barrier 200 may be affixed to the rigid framing member 600 though pressure clamping technique promoted by the cross-sectional geometry of the perimeter trim member leg 801 by the engagement of said perimeter trim member leg 801 into the receiver slot 800 of said rigid framing member 600 securing the infill barrier 200 between perimeter trim member leg 801 and said receiver slot 800 within the rigid framing member 600 of said panel frame assembly 201.

It is understood that any components or materials can be formed from a same, structural continuous piece or separately fabricated and connected.

Example embodiments are described herein with reference to figures that are schematic illustrations of idealized embodiments. As such, variations from these shapes of the illustrations as a result, for example, of manufacturing techniques and/or tolerances, are to be expected. Thus, example embodiments described herein should not be construed as limited to the particular shapes of regions as illustrated herein, but are to include deviations in shape that result, for example, from manufacturing. For example, a region illustrated as flat or planar may, typically, have rough and/or non-linear or non-planar features. Moreover, sharp angles that are illustrated may be rounded and rounded edges may be angled. Thus, the regions illustrated in the figures are schematic in nature and their shapes are not intended to illustrate precise shape of a region and are not intended to limit the scope of the present claims.

Although the present disclosure has been described with reference to preferred embodiments, persons skilled in the art will recognize that changes may be made and numerous variations in form and detail are possible without departing from the spirit and scope of the invention. The scope of this present disclosure also includes embodiments having different combinations of features and embodiments that do not include all of the above-described features.

What is claimed is:

1. A lightweight thermal barrier panel and an anchor assembly including at least one anchor member for installation over a building envelope assembly to create an air cavity between the thermal barrier panel and the building envelope assembly, comprising:

- a stretched membrane infill barrier comprising: a non-combustible membrane material with at least a first and second side with a plurality of perimeter edges; and
- a rigid panel frame assembly with at least a first side and second side comprising:
  - a plurality of framing assembly members, wherein the plurality of framing assembly members are disposed and affixed to adjacent framing assembly members of the plurality of framing assembly members through mechanical fixity resulting in a plurality of edges of the panel frame assembly, wherein each framing assembly member of the plurality of framing assembly members comprises:
- at least one mullion member comprising;
  - a rigid material with a cross-sectional geometry wherein:
    - at least one first groove is configured to receive and affix the infill barrier with at least one pressure fitting;
    - at least one second groove is configured to receive a buffer gasket to separate the infill barrier from the framing assembly member;
    - at least one third groove is configured to engage a fastening mechanism to join adjacent mullion members from the plurality of framing assembly members;

at least one first surface is configured to engage with the at least one anchor member of the anchor assembly; and at least one second surface is configured to engage with at least one perimeter trim member; and at least one of the framing assembly members of the panel frame assembly has at least one penetration through the framing assembly members to vent across at least one side of the thermal barrier panel to at least another side of the thermal barrier panel; and the at least one pressure fitting comprises:

a rigid material with cross sectional geometry that enables the at least one pressure fitting to affix at least one edge of the infill barrier to the at least one first groove; and the at least one perimeter trim member comprises:

a non-combustible rigid material with a cross sectional geometry wherein: at least one fourth groove is configured to receive at least one perimeter sealing gasket; and wherein the at least one perimeter trim member is configured to couple to receive the at least one million member of the plurality of framing assembly members; and the at least one perimeter sealing gasket comprises:

a flexible material with a cross sectional geometry wherein:

at least one edge of the perimeter sealing gasket is configured to couple to the at least one perimeter trim member; and at least one third surface of the perimeter sealing gasket is configured to engage an opposing fourth surface of the perimeter sealing gasket of at least one perimeter edge of an adjacent thermal barrier panel or at least one fifth surface of the building envelope assembly to create an air seal; and the anchor assembly is configured to attach at least one edge of the one or more thermal barrier panels to at least one side of the building envelope assembly to form the air cavity between the thermal barrier panel and the building envelope assembly, wherein:

the anchor assembly comprises the at least one anchor member made of a rigid material wherein:

the at least one anchor member receives and affixes the at least one framing assembly member of the plurality of framing assembly members to at least one side of the building envelope assembly and the at least one anchor member is configured to promote the movement and operation of the thermal barrier panel relative to the building envelope assembly for access to the air cavity; and the at least one anchor member is configured to promote the securing of the thermal barrier panel in a closed position wherein the thermal barrier panel encloses the air cavity; wherein the thermal barrier panel is disposed and attached to at least one side of the building envelope assembly by the anchor assembly such that the thermal barrier panel creates the air cavity between at least one side of the thermal barrier panel and at least one side of the building envelope assembly.

2. The lightweight thermal barrier panel and the anchor assembly of claim 1, wherein the thermal barrier panel comprises a plurality of infill barriers.

3. The lightweight thermal barrier panel and the anchor assembly of claim 2, wherein at least one of the plurality of infill barriers is a rigid sheet-like panel.

4. The lightweight thermal barrier panel and the anchor assembly of claim 3, further comprising a second infill barrier, wherein the second infill barrier is affixed to the panel frame assembly with an adhesive.

5. The lightweight thermal barrier panel and the anchor assembly of claim 3, further comprising a second infill barrier, wherein the second infill barrier is a rigid sheet-like panel connected to the panel frame assembly with a second pressure fitting.

6. The lightweight thermal barrier panel and the anchor assembly of claim 1, wherein the infill barrier further comprises an applied opacified, patterned coating;

wherein the pattern comprises one or more of dots, lines, bars, or a combination thereof, and a coating coverage ranges between zero to one hundred percent visibility from at least the first side to at least the second side of the infill barrier.

7. The lightweight thermal barrier panel and the anchor assembly of claim 1, further comprising at least one secondary member configured to support the infill barrier.

8. The lightweight thermal barrier panel and the anchor assembly of claim 1, wherein the anchor assembly is configured to create a rigid connection and does not promote movement of the thermal barrier panel.

9. The lightweight thermal barrier panel and the anchor assembly of claim 1, further comprising at least one perimeter framing member penetration configured to receive at least one vent baffle to manage a flow of air from the air cavity to at least one of the first side or the second side of the infill barrier.

10. The lightweight thermal barrier panel and the anchor assembly of claim 9, wherein the at least one vent baffle comprises; a heat sensitive material such that the vent baffle promotes opening and closing of the perimeter framing member penetration and ventilation of the air cavity.

11. A system comprising a plurality of the lightweight thermal barrier panels and the anchor assemblies of claim 1, wherein the plurality of thermal barrier panels are anchored to at least one side of the building envelope assembly with at least one edge of a first thermal barrier panel adjacent to at least one edge of a second thermal barrier panel, forming a thermal barrier panel joint therebetween, to wherein the perimeter sealing gasket of the first thermal barrier panel engages the perimeter scaling gasket of the second, thermal barrier panel to seal the air cavity at the thermal barrier panel joint.

12. A system comprising a plurality of the lightweight thermal barrier panels and the anchor assemblies of claim 1, wherein the plurality of thermal barrier panels are disposed on at least one side of the building envelope assembly; and at least one panel closure baffle is disposed on at least one side of the thermal barrier panel, protruding into the air cavity with respect to the thermal barrier panel, the panel closure baffle separating the air cavity of a first thermal barrier panel of the plurality of thermal barrier panels from the air cavity of adjacent thermal barrier panels.

13. The lightweight thermal barrier panel and the anchor assembly of claim 1, wherein the air cavity comprises a plurality of air cavities, wherein a depth of the plurality of air cavities varies in depth across one or more of the one or more thermal barrier panels.

14. A method for installing a lightweight panelized thermal barrier panel comprising an ethylene tetrafluoroethylene membrane having a thickness ranging from 12 nanometers to 500 nanometers, inclusive for installation over a building envelope assembly to create an air cavity between the thermal barrier panel and the building envelope assembly, comprising:

at least one anchor member fastened to at least one side of the building envelope assembly such that the thermal barrier panel receives the at least one anchor member and affixes the at least one anchor member to a slot of the thermal barrier panel to at least one side of the building envelope assembly, wherein:

the at least one thermal barrier panel is disposed over at least one side of the building envelope assembly such that the thermal barrier panel creates the air cavity between at least one side of the thermal barrier panel and at least one side of the building envelope assembly, wherein:

a perimeter sealing gasket and a closure baffle engage the at least one first surface of an adjacent thermal barrier panel to promote the perimeter sealing gasket to seal the air cavity.

15. The method of claim 14, wherein the at least one anchor member is affixed to the building envelope assembly by an adhesive.

16. The method of claim 14, wherein the at least one anchor member is affixed to the building envelope assembly by mechanical fastener or fixity technique.

17. The method of claim 14, wherein the thermal barrier panel comprises:

a mullion and transom configured in a framework to receive and secure a sheet like rigid material within an opening defined by the mullion and transom through a pressure plate assembly, wherein a building mullion cover cap is removed to expose the pressure plate assembly, the at least one anchor member is affixed to one side of the pressure plate assembly with at least one fastener passing through the at least one anchor member and the pressure plate assembly into a building mullion or transom of the building envelope assembly, the adjacent thermal barrier panels are received and connected by the at least one anchor member.

18. The method of claim 14, wherein a plurality of the thermal barrier panels comprises:

a mullion and transoms wherein an outer most surface of the mullion facing the air cavity is a fully integrated and fixed portion to create a panel capture space of the mullion, wherein the at least one anchor member is affixed to at least one second surface of the mullion with at least one fastener passing through the at least one anchor member into a building mullion of the building envelope assembly, the plurality of thermal barrier panels is received and connected to the building envelope assembly by the at least one anchor member.

19. The method of claim 14, wherein a plurality of the thermal barrier panels comprises:

mullions and transoms configured in a framework to receive and secure a sheetlike rigid material within an opening defined by an edge extrusion and an exposed adhesive on the mullions and transoms wherein at least one portion of the adhesive along at least one existing mullion or transom is removed to expose an adhesive receiving side of the edge extrusion, wherein the at least one anchor member is affixed to at least one side of the edge extrusion with at least one fastener passing through the at least one anchor member and the edge extrusion and the portion of removed adhesive is replaced with a new adhesive, such that the plurality of thermal barrier panels are received and connected by the at least one anchor member.

* * * * *